US008218404B2

(12) United States Patent
Takahashi

(10) Patent No.: US 8,218,404 B2
(45) Date of Patent: Jul. 10, 2012

(54) APPARATUS AND METHOD FOR RECORDING CONTENT INFORMATION WHICH SATISFIES A PREDETERMINED STANDARD

(75) Inventor: Kazuma Takahashi, Kanagawa (JP)

(73) Assignee: Sony Corporation (JP)

( * ) Notice: Subject to any disclaimer, the term of this patent is extended or adjusted under 35 U.S.C. 154(b) by 1178 days.

(21) Appl. No.: 12/070,426

(22) Filed: Feb. 19, 2008

(65) Prior Publication Data

US 2008/0198705 A1 Aug. 21, 2008

(30) Foreign Application Priority Data

Feb. 21, 2007 (JP) ..... P2007-041454

(51) Int. Cl.
*H04H 60/27* (2008.01)

(52) U.S. Cl. ..... 369/7; 455/184.1; 455/186.1

(58) Field of Classification Search ..... 369/7, 6, 369/1, 2, 3, 4, 8; 455/184.1, 78, 79, 186.1; 709/232, 203, 213, 231, 244; 386/248, 239, 386/291, 292
See application file for complete search history.

(56) References Cited

U.S. PATENT DOCUMENTS

| | | | | |
|---|---|---|---|---|
| 7,222,185 | B1 * | 5/2007 | Day | 709/232 |
| 2004/0116088 | A1 * | 6/2004 | Ellis et al. | 455/132 |
| 2005/0020223 | A1 * | 1/2005 | Ellis et al. | 455/186.1 |
| 2006/0153526 | A1 | 7/2006 | Kimura | |
| 2010/0046915 | A1 * | 2/2010 | Ueda et al. | 386/94 |
| 2010/0070350 | A1 * | 3/2010 | Paunikar et al. | 705/14.1 |

FOREIGN PATENT DOCUMENTS

| | | | |
|---|---|---|---|
| JP | 07226886 | A | 8/1995 |
| JP | 2006086667 | A | 3/2006 |
| JP | 2006140583 | A | 6/2006 |
| JP | 2006-186673 | A | 7/2006 |
| JP | 2006332750 | A | 12/2006 |
| JP | 2006352264 | A | 12/2006 |
| JP | 2008113313 | A * | 5/2008 |

OTHER PUBLICATIONS

The Computer translation of document JP 2006-086667 (pub Mar. 30, 2006 ).*

* cited by examiner

*Primary Examiner* — Tan X Dinh
(74) *Attorney, Agent, or Firm* — Lerner, David, Littenberg, Krumholz & Mentlik, LLP

(57) ABSTRACT

A recording apparatus including: a receiving portion for receiving a content data sent using radio wave; a recording portion for recording the content data received by the receiving portion in a storage medium; a determining portion for determining whether or not a receiving status of the content data by the receiving portion satisfies a predetermined standard; and a control portion for when the determining portion determines that the standard is not satisfied, controlling the recording portion to stop recording of the content data to the storage medium.

10 Claims, 15 Drawing Sheets

FIG.9

| CONTENT ID | TITLE | GENRE | RECORDING DATE | RECORDING INTERRUPTION | RECORDING INTERRUPTION PERIOD |
|---|---|---|---|---|---|
| 14114411 | SCIENCE FOR ELEMENTARY SCHOOL MOVEMENT OF CLOUD | EDUCATION | 2007/1/4 | YES | T1~T2 |

APPARATUS AND METHOD FOR RECORDING CONTENT INFORMATION WHICH SATISFIES A PREDETERMINED STANDARD

CROSS-REFERENCE TO RELATED APPLICATIONS

The present application claims priority from Japanese Patent Application No. JP 2007-041454, filed in the Japanese Patent Office on Feb. 21, 2007, the entire content of which is incorporated herein by reference.

BACKGROUND OF THE INVENTION

1. Field of the Invention

The present invention relates to a recording apparatus, recording method and program.

2. Description of the Related Art

In recent years, a portable apparatus having radio communication function has been widely prevailed. Service of broadcasting station's sending content data such as TV program and radio broadcasting to the portable apparatus using radio wave has been provided. Thus, user possessing the portable apparatus can receive radio wave sent by broadcasting station and watch/listen to the content data through the portable apparatus even during traveling or outdoor.

The portable apparatus is capable of storing received content data in its storage medium. For example, the portable apparatus is capable of recording the content data in the storage medium based on reservation information set preliminarily by user and a user operation to an operating portion which accepts start of recording.

However, the content data sent using radio wave may not be received properly depending on the environment surrounding the portable apparatus. For example, when user carrying the portable apparatus enters a tunnel, radio wave does not reach his or her portable apparatus, so that the portable apparatus is incapable of receiving the content data properly. In conditions in which the portable apparatus is incapable of receiving the content data properly, the content data recorded in the portable apparatus is not displayed on its screen at the time of reproduction, no sound is produced or much noise is mixed thereby sometimes disabling the content data from being watched or listened to.

Japanese Patent Application Laid-Open No. 2006-186673 has disclosed a control method for blocking a content data difficult to enjoy for the above-described reason from being recorded in the portable apparatus. According to the control method, whether or not the portable apparatus is capable of receiving content data prior to a reserved recording start time is determined and if it is determined that it is difficult to be received properly, user is notified thereof. This notice is effective for urging user to move his or her portable apparatus to a place where it can receive the content data properly.

SUMMARY OF THE INVENTION

However, the receiving condition of the content data in the portable apparatus changes irregularly corresponding to changes of the surrounding environment. For the reason, the control method of related art has an issue that the content data difficult to watch/listen to properly is recorded in the portable apparatus if the receiving condition is deteriorated during recording of the content data or user can hardly move his or her portable apparatus to a place preferable for receiving by a recording start time. Further, because the storage capacity of a storage medium which stores the content data is finite, it is desirable to exclude the content data difficult to watch/listen to from the storage medium from viewpoints of effective use of the storage capacity.

Accordingly, the present invention has been achieved in views of the above-described issues and the invention intends to provide a novel, improved recording apparatus, recording method and program capable of suppressing a data amount of a portion difficult to watch/listen to of the content data to be recorded in the storage medium.

According to an embodiment of the present invention, there is provided a recording apparatus including: a receiving portion for receiving a content data sent using radio wave; a recording portion for recording the content data received by the receiving portion in a storage medium; a determining portion for determining whether or not a receiving status of the content data by the receiving portion satisfies a predetermined standard; and a control portion for when the determining portion determines that the standard is not satisfied, controlling the recording portion to stop recording of the content data to the storage medium.

With such a structure, the recording portion, when it is determined that the received condition of the content data does not satisfy a predetermined standard by the determining portion, stops recording of the content data into the storage medium. Here, if the determining portion is configured to determine that the predetermined standard is not satisfied when the received condition is not excellent, the recording portion refrains from recording the content data received under an environment in which the received condition is poor into the storage medium. That is, by configuring the determining portion so that it does not determine that the predetermined standard is not satisfied when the received condition is not excellent, the recording portion can be blocked from recording content data having an inferior quality into the storage medium. As a result, the storage capacity of the storage medium can be used effectively.

When it is determined that the aforementioned standard is satisfied by the determining portion, the recording portion may record the content data into the storage medium. With such a structure, if it is determined that the received condition of the content data satisfies the standard when recording of the content data is stopped based on determination of the determining portion, the recording portion can restart recording of the content data into the storage medium.

As a result, while the received condition of the content data satisfies the predetermined standard, the recording portion can record the content data into the storage medium. Therefore, such an issue that user has no way for knowing until when reproduction of the content data difficult to watch/listen to will be continued at the time of reproduction of the content data or user is forced to execute rapid feed operation in order to avoid reproduction of the content data difficult to watch/listen to can be eliminated.

When recording of the content data is stopped at a predetermined data position, the recording portion may record notification information indicating the recording of the content data is stopped at the predetermined data position, into the storage medium. With such a structure, if the recording of the content data is stopped based on a determination by the determining portion, the recording portion indicates that the recording of the content data is stopped and then records the notification information capable of specifying a data position in which the recording is stopped into the storage medium. Thus, user can grasp whether or not the recording of the content data is stopped based on the notification information.

The notification information is image information or sound information indicating that recording of the content data is stopped and may be inserted into a predetermined data position. With such a structure, the notification information such as image information or sound information indicating that recording of the content data is stopped is recorded in the storage medium continuously with a predetermined data position in which the recording of the content data is stopped. Consequently, when a reproduction position of the content data reaches a recording stop position of the content data, the recording apparatus can reproduce image notification information indicating "recording is stopped temporarily" without any special processing.

If recording of the content data is stopped in a period from time T1 to time T2, image information or sound information indicating that recording of the content data is stopped at time T1 is recorded in the storage medium subsequent to the content data up to time T1. After that, content data after time T2 is recorded. When the content data up to time T1 is reproduced at the time of reproduction of the content data, image information or sound information indicating that recording of the content data is stopped at time T1 is reproduced without any special processing, so that user can grasp that recording of the content data is stopped at time T1.

The notification information is meta data containing information indicating the predetermined data position and may be recorded in correspondence to the content data. With such a structure, the meta data containing information indicating the data position in which recording of the content data is stopped is memorized in correspondence to the content data. Therefore, the recording apparatus can carry out processing based on the meta data matched to the content data at the time of reproduction of the content data.

The recording apparatus may further include a reproducing portion for reproducing the content data memorized in the storage medium, wherein the reproducing portion, when the notification information is matched to one of the content data to be reproduced, reproduces image information or sound information indicating that recording of the content data is stopped at a position in which the recording of the content data is stopped, based on the notification information.

With such a structure, the reproducing portion can notify user that recording of the content data is stopped at the recording stop position based on information indicating a recording stop position contained in the meta data. For example, when reproduction of the content data reaches that recording stop position, the reproducing portion reproduces an image and sound indicating that recording of the content data is stopped so as to notify user that recording of the content data is stopped.

The notification information may contain stop information indicating a data range in which recording of the content data by the recording portion is stopped. With such a structure, the recording apparatus can notify a data range in which the recording of the content data is stopped based on the notification information at the time of reproduction of the content data. If the recording of the content data is stopped in a period from time T1 to time T2, the notification information containing stop information indicating that the recording of the content data is stopped in the period from time T1 to time T2 may be recorded in the storage medium. Consequently, if the reproduction position of the content data reaches a position corresponding to time T1, the recording apparatus can reproduce image and sound indicating that the recording of the content data is stopped in the period from time T1 to time T2 so as to notify user thereof.

Identification information of each of the content data is matched to the content data, and the recording apparatus may further include a sending request portion for requesting resending of the content data of a range in which the recording is stopped, based on the identification information matched to the content data and stop information contained in the notification information.

With such a structure, the sending request portion can send identification information matched to the content data and stop information contained in the notification information to a sender unit of the content data as a request for resending the content data. The sender unit of the content data can send received stop information of the content data corresponding to the received identification information to the recording apparatus corresponding to such a request for resending.

Therefore, the recording apparatus can receive a portion not recorded by the recording portion based on a determination of the determining portion of the content data from the sender unit. As a result, the recording apparatus can replenish a missing portion because recording of the content data is stopped of the content data recorded in the storage medium.

The determining portion, when the signal intensity of content data received by the receiving portion is below a predetermined threshold, may determine that the received condition of the content data does not satisfy the standard. Here, the signal intensity affects the quality of the content data. For example, the higher the signal intensity, the higher the quality of the content data is. The lower the signal intensity, the lower the quality of the content data is. Thus, if the signal intensity corresponding to the lower limit value of an allowable quality level of the content data is regarded as a threshold and the determining portion determines that the received condition of the content data does not satisfy a standard when the signal intensity of the content data is lower than the threshold, the recording portion can record only the content data of the allowable quality level in the storage medium. As a result, if the signal intensity corresponding to the lower limit value of the allowable quality level of the content data is regarded as the threshold, user can watch/listen to only the content data of the allowable quality level.

The determining portion may change the predetermined threshold corresponding to data type of the content data. For example, it is permissible to set a threshold of the signal intensity for use by the determining portion for determination depending on which the data type of the content data is picture, music or still image.

With such a structure, if the signal intensity of the content data received is of an intensity capable of securing the quality of sound even if it is not of an intensity capable of securing the quality of picture, the determining portion can determine that the standard is not satisfied if the content data is video data and can determine that the standard is satisfied if the content data is sound data. In this case, although the recording portion stops recording if the content data is video data, it can continue the recording if the content data is sound data.

The determining portion, when plural data types are contained in the content data, may determine whether or not the received condition of the content data satisfies the standard for each of the data types contained in the content data. For example if the content data contains plural data types such as picture, music and still image, the threshold of the signal intensity for use by the determining portion for determination may be set for each data type.

With such a structure, if the signal intensity of the received content data is of an intensity capable of securing the quality of sound even if it is not of an intensity capable of securing the quality of image, the determining portion may determine that video data contained in the content data does not satisfy the standard and can determine that the sound data contained in the content data satisfies the standard. In this case, although the recording portion stops recording of the video data contained in the content data, it continues recording of the sound data contained in the content data. As a result, because a portion capable of outputting sound of the content data is generated although no image can be displayed, user can obtain more information from the content data.

The determining portion, when an average of the signal intensity of radio wave received by the receiving portion is equal to or lower than the threshold, may determine that the received condition of the content data does not satisfy the standard. The signal intensity of the content data received by the receiving portion sometimes can drop temporarily due to a sudden change of the environment. It is not effective that the determining portion determines that the standard is not satisfied each time when the signal intensity drops momentarily to make the recording portion switch between recording and stop of the recording of the content data. Further, stopping of recording of the content data too frequently is troublesome from viewpoints of user side.

As described above, the determining portion determines that the received condition of the content data does not satisfy the standard if the average of the signal intensity of the content data is equal to or lower than the set threshold. Consequently, even if the signal intensity drops temporarily due to a sudden change of the environment, recording of the content data can be continued. In the meantime, the average of the signal intensity may be calculated according to an average calculation method such as partitioned average method and moving-average method.

According to another embodiment of the present invention, there is provided a recording method including the steps of: receiving content data sent using radio wave; determining whether or not the received condition of the content data satisfies a predetermined standard; and stopping recording of the content data to the storage medium, when it is determined that the received condition does not satisfy the standard.

With such a structure, while the received condition of the content data does not satisfy the predetermined standard, no content data is recorded. As a result, the storage capacity of the storage medium which memorizes the content data can be used effectively.

According to another embodiment of the present invention, there is provided a recording apparatus including: a receiving means for receiving content data sent using radio wave; a recording means for recording the content data received by the receiving means into a storage medium; a determining means for determining whether or not received condition of the content data by the receiving means satisfies a predetermined standard; and a control means which when the determining means determines that the standard is not satisfied, controls the recording device to stop recording of the content data to the storage medium.

According to the embodiments of the present invention described above, a data amount of a portion difficult to watch/listen to of a content data to be recorded in the storage medium can be suppressed.

BRIEF DESCRIPTION OF THE DRAWINGS

FIG. 9 is an explanatory diagram showing an example of meta data containing information concerning recording stop of the content data;

DETAILED DESCRIPTION OF THE PREFERRED EMBODIMENTS

Figure 1:
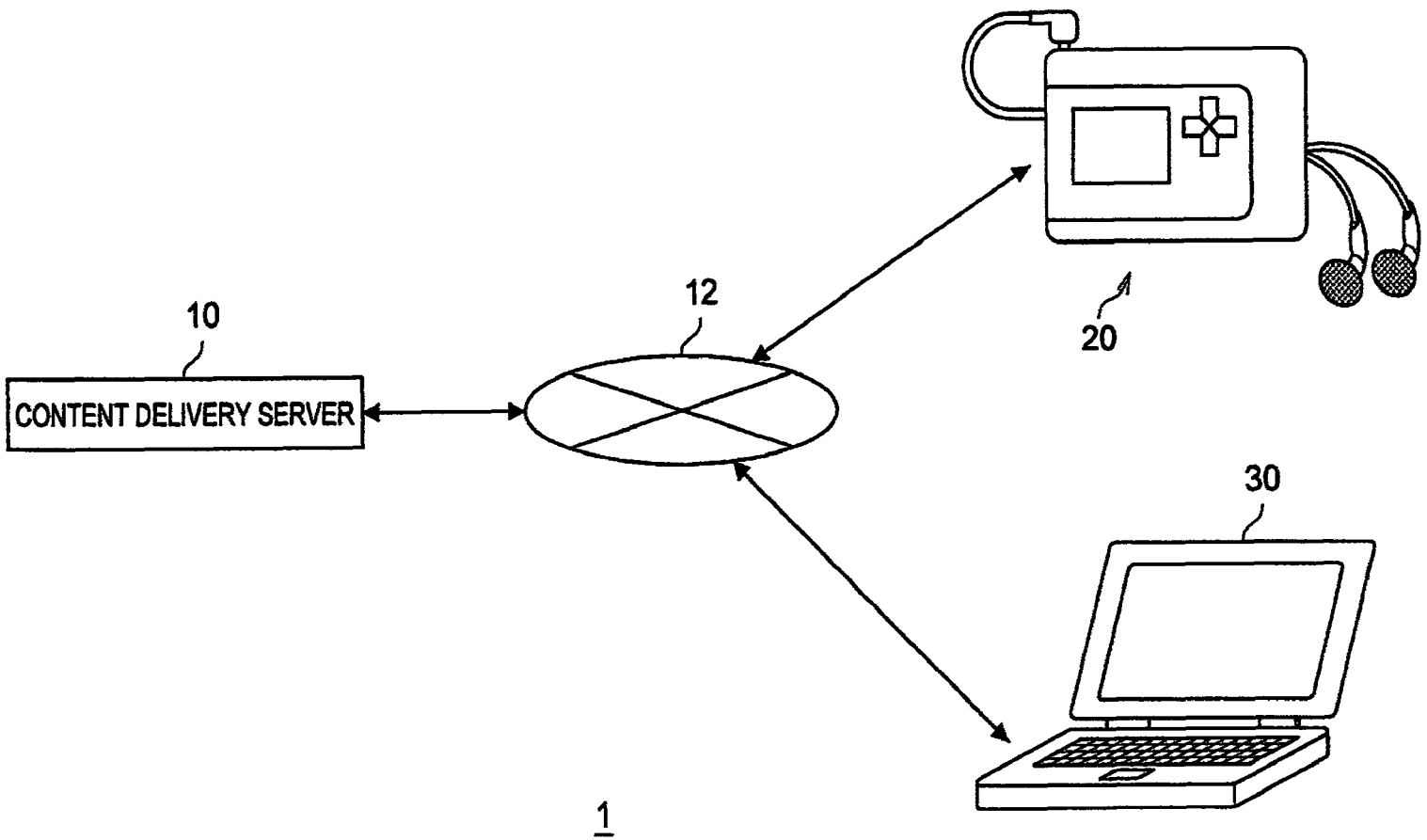
FIG. 1 is an explanatory diagram showing the configuration of a content recording system according to a first embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

First Embodiment

First, as a recording apparatus of the first embodiment of the present invention, a portable apparatus 20 will be described. After explaining a content recording system 1 according to this embodiment with reference to FIG. 1 and FIG. 2, the configuration and operation of the portable apparatus 20 according to this embodiment will be described with reference to FIG. 3-FIG. 10.

FIG. 1 is an explanatory diagram showing the configuration of the content recording system 1 according to this embodiment. The content recording system 1 includes a content delivery server 10, communication network 12, portable apparatus 20 and PC 30 and enables the portable apparatus 20 to record content data.

The content delivery server 10 distributes, sends or broadcasts content data to the portable apparatus 20 or the PC 30 through the communication network 12. For example, the content delivery server 10 can perform one-segment broadcasting of sending digital type content data using radio wave which serves as the communication network 12 or broadcasting of digital radio. In the meantime, the communication network 12 may include wire cable such as copper wire and optical fiber, a data transmission path constituted of radio wave or a data relay unit such as a base station for controlling a router and communication.

The content data is a concept including music data such as music, lecture, and radio program, video data and/or sound data such as movie, TV program, video program, photograph, document, picture and tables, and arbitrary data such as game and software.

The PC 30 can record the content data broadcasted from the content delivery server 10 through the communication network 12 in its storage medium. Further, the PC 30 can record the content data stored in an optical disk such as CD-R (Compact Disk Recordable)/RW (Rewritable), DVD-R (Digital Versatile Disk Recordable)/RW/+R/+RW/RAM (Random Access Memory) and BD (Blu-Ray Disc (registered trademark))-R/BD-RE in an incorporated storage medium.

The PC 30 can send the content data recorded in the incorporated storage medium to the portable apparatus 20 or control the content data stored in the portable apparatus 20 and data structure of a retrieval database for the content data. Here, the PC 30 can send the content data to the portable apparatus 20 by downloading style or by streaming style. The streaming style is a method of sending the content data in time series synchronously with reproduction speed of the content data in the portable apparatus 20. On the other hand, the downloading style is a sending method which enables the content data in the portable apparatus 20 to be reproduced after the entire content data is sent to the portable apparatus 20.

The portable apparatus 20 can record the content data sent from the content delivery server 10 or the content data sent from the PC 30 in the storage medium. Further, the portable apparatus 20 stores retrieval database in which meta data corresponding to one or two or more content data is hierarchized in order to retrieve for content data recorded in the storage medium. The portable apparatus 20 has a function of reproducing content data corresponding to the meta data retrieved using the retrieval database. An example of the appearance of the portable apparatus 20 will be described with reference to FIG. 2.

Figure 2A:
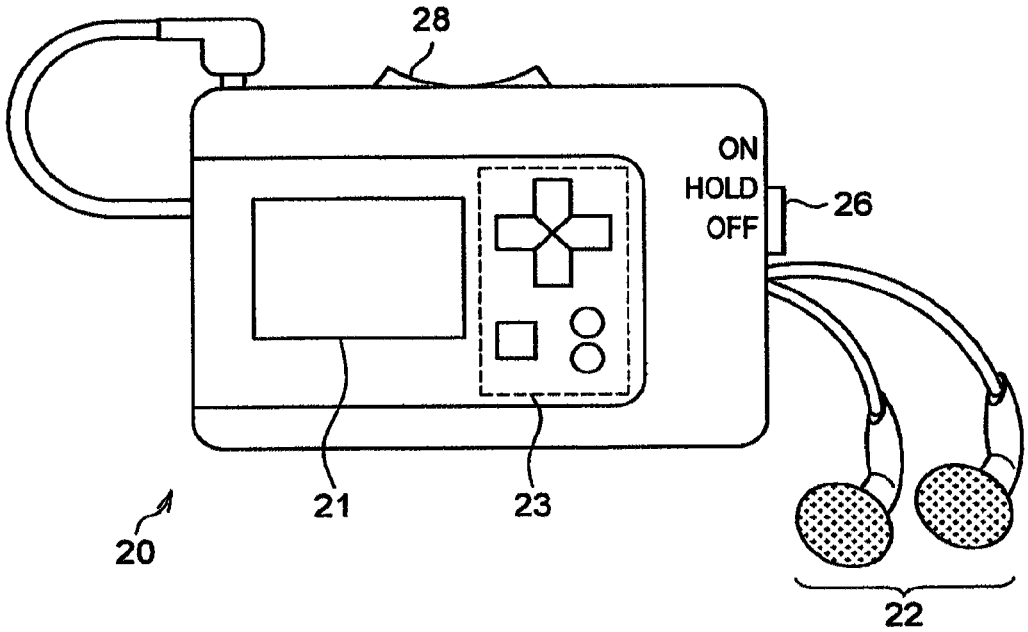
FIG. 2 is an explanatory diagram showing an example of an appearance of a portable apparatus according to the first embodiment.
Figure 2B:
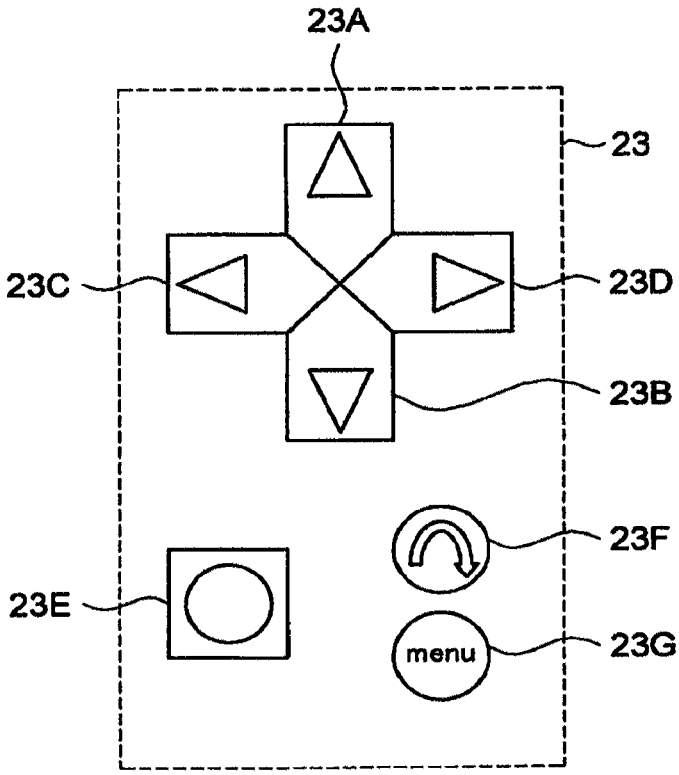

FIG. 2 is an explanatory diagram showing an example of the appearance of the portable apparatus 20 according to this embodiment. In more specific terms, FIG. 2A is a front view of the portable apparatus 20 according to this embodiment and FIG. 2B is an explanatory diagram showing an instruction operating portion 23 of the portable apparatus 20 according to this embodiment in enlargement. Referring to FIG. 2A, the portable apparatus 20 includes a display portion 21, sound output portion 22, instruction operating portion 23, hold operating portion 26 and sound level operating portion 28.

The display portion 21 has a function of displaying an image, and it may be, for example, a liquid crystal display (LCD), organic EL (Electro Luminescence) display or plasma display. An image based on image data contained in the content data or an image indicating a reproduction status of the content data is displayed on the display portion 21.

The sound output portion 22 has a function of outputting sound based on sound data contained in the content data. In the meantime, FIG. 2A just indicates an earphone as an example of the sound output portion 22 and the sound output portion 22 may be a speaker or a headphone.

The instruction operating portion 23 instructs execution of a predetermined processing to the portable apparatus 20 and detects an instruction operation of instructing a data input to the portable apparatus 20. The predetermined processing includes, for example, reproduction of the content data, temporary stop of the content data, rapid feed of the content data and winding back of the content data. As shown in FIG. 2B, the instruction operating portion 23 contains a cross key composed of an upper button 23A, lower button 23B, left button 23C and right button 23D, a decision button 23E, a return button 23F and a menu button 23G.

The respective buttons 23A-23D constituting the cross key is used to set a cursor to each of selection items displayed on the display portion 21. For example, when the upper button 23A is pressed, the cursor is moved upward and when the lower button 23B is pressed, the cursor is moved downward. When the left button 23C is pressed, the cursor is moved to the left and when the right button 23D is pressed, the cursor is moved to the right. The selection items include a content name, album name, type of meta data of a content to be edited and the like.

The decision button 23E is used to execute a selection item on which the cursor is set. The return button 23F is used to return a display screen represented on the display portion 21 to a previous status. The menu button 23G is used to display a menu screen for selecting which is to be executed of setting of the meta data of the content data or setting of a screen style to be displayed on the display portion 21.

The cross key and the decision button 23E are indicated just as an example of a specific structure of the instruction operating portion 23 and the instruction operating portion 23 may be constituted of, for example, a touch panel, button, switch, lever, dial or a receiving portion for infrared ray signal generated by a remote controller.

The hold operating portion 26 detects an operation by user for switching a setting on whether or not an instruction operation for instructing execution of a predetermined processing to the instruction operating portion 23 is accepted. When user performs setting operation of turning the hold operating portion 26 to ON, hold ON status which does not accept an instruction operation of instructing execution of a predetermined processing to the instruction operating portion 23 arises and when user performs release operation of turning the hold operating portion 26 to OFF, hold OFF status which accepts an instruction operation of instructing execution of the predetermined processing to the instruction operating portion 23 arises. For example, when the hold operating portion 26 is turned OFF, the portable apparatus 20 reproduces a content based on a reproduction instruction operation of instructing reproduction of the content and when the hold operating portion 26 is turned ON, the portable apparatus 20 may refrain from reproduction of the content even if a reproduction instruction operation of instructing reproduction of the content is detected.

The sound level operating portion 28 has a function of adjusting the level of sound reproduced from the earphone 22. For example, the sound level operating portion 28 may be configured to reduce the sound level when one side of the sound level operating portion 28 is pressed and increase the sound level when the other side of the sound level operating portion 28 is pressed.

Although FIG. 1 and FIG. 2 show the portable apparatus 20 as an example of the recording apparatus, the recording apparatus may be any of such information processing units as portable phone, PHS (Personal Handyphone System), portable music reproducing unit, portable video processing unit, PDA (Personal Digital Assistant) portable game machine, household machine.

As described above, the portable apparatus 20 according to this embodiment can record content data sent from the content delivery server 10 or the PC 30 using radio wave in its storage medium. Sometimes the portable apparatus 20 can hardly receive content data sent using radio wave properly depending on the environment around the portable apparatus 20. For example, if user carrying the portable apparatus 20 enters the underground, radio wave does not reach the portable apparatus 20 sufficiently, so that the portable apparatus 20 can hardly receive content data properly. If the portable apparatus 20 can hardly receive the content data properly, sometimes it is difficult to watch or listen to content data recorded in the portable apparatus 20 properly because its image is not displayed at the reproduction, no sound is produced or much noise is mixed.

Because the storage capacity of a storage medium which stores the content data is limited, the content data difficult to watch/listened to is desired to be excluded form the storage medium from viewpoints of effective use of the storage capacity. Thus, the portable apparatus 20 according to this embodiment has been created by paying attention to such a circumstance. The portable apparatus 20 according to this embodiment can suppress data amount of a portion difficult to watch/listened to in the content data to be recorded in the storage medium. Hereinafter, the portable apparatus 20 according to this embodiment will be described in detail with reference to FIG. 3-FIG. 10.

Figure 3:
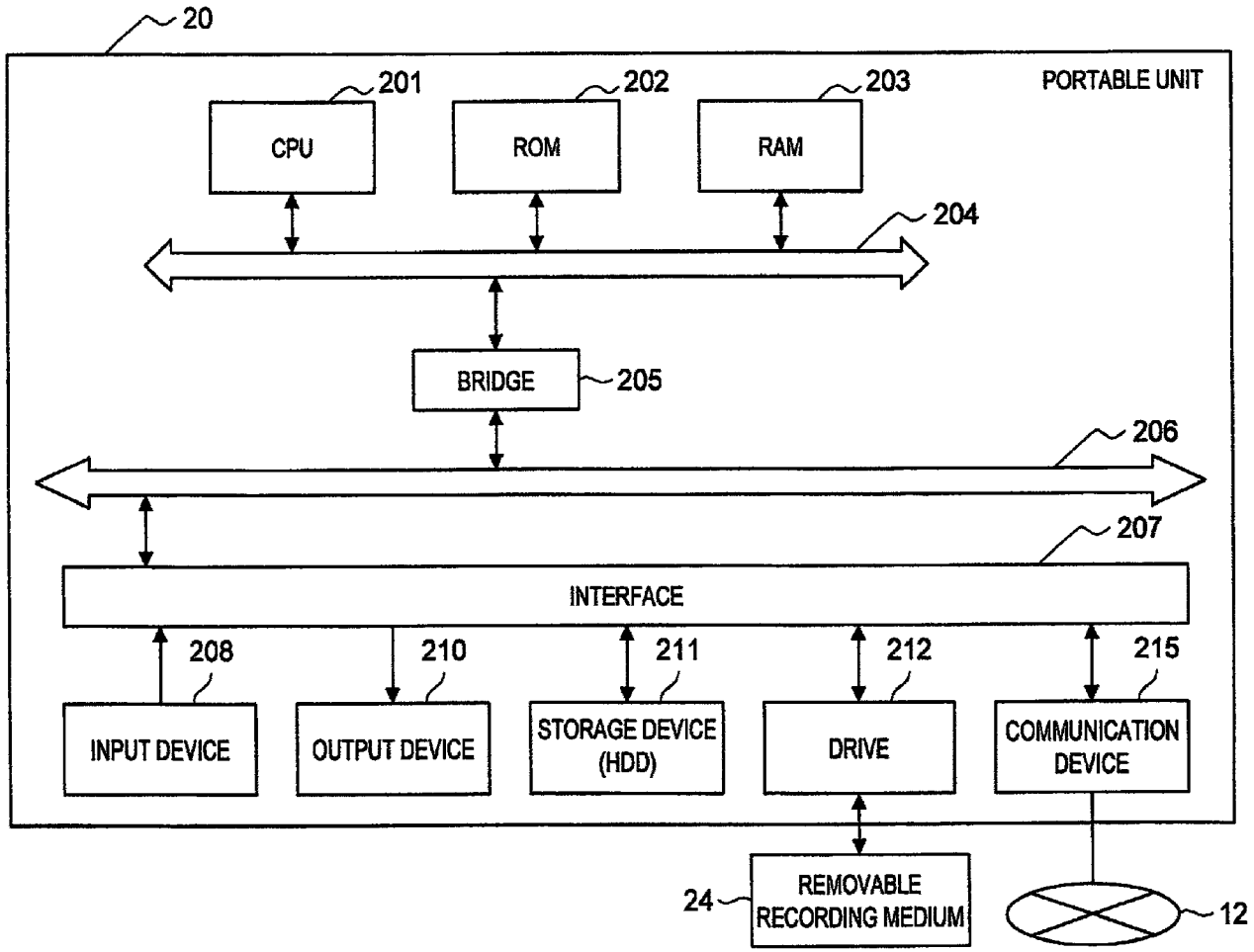
FIG. 3 is an explanatory diagram showing the configuration of hardware of the portable apparatus according to the first embodiment.

FIG. 3 is an explanatory diagram showing the configuration of hardware of the portable apparatus 20 according to this embodiment. The portable apparatus 20 includes CPU (Central Processing Unit) 201, ROM (Read Only Memory) 202, RAM (Random Access Memory) 203, host bus 204, bridge 205, external bus 206, interface 207, input device 208, output device 210, storage device (HDD) 211, drive 212 and communication unit 215.

The CPU 201 functions as an arithmetic processing unit and a control unit so as to control the entire operation of the portable apparatus 20 following various programs. The CPU 201 may be a micro processor. The ROM 202 stores programs, arithmetic operation parameters and the like for use by the CPU 201. The RAM 203 stores a program for use in execution by the CPU 201 and parameter which changes appropriately during the execution temporarily. These components are connected to one another through the host bus 204 composed of CPU bus or the like.

The host bus 204 is connected to the external bus 206 such as PCI (Peripheral Component Interconnect/Interface) through the bridge 205. In the meantime, the host bus 204, the bridge 205 and the external bus 206 are not necessarily configured separately but it is permissible to mount these functions on one unit.

The input unit 208 is constituted of the instruction operating portion 23 for user to input information, such as a mouse, keyboard, touch panel, button, microphone, switch and lever and an input control circuit for generating an input signal based on user's input and outputting to the CPU 201. User can input various kinds of data or instruct a processing action to the portable apparatus 20 by operating the input unit 208.

The output unit 210 is constituted of, for example, a display unit such as CRT (Cathode Ray Tube) display unit, liquid crystal display (LCD) unit and a lamp and a sound output unit such as a speaker and headphone. The output unit 210 outputs, for example, a reproduced content. More specifically, the display unit corresponding to the display portion 21 displays various kinds of information such as reproduced video data in the form of a text or image. On the other hand, the sound output unit corresponding to the sound output portion 22 converts reproduced sound data to sound and outputs it.

The storage device 211 is a device for data storage constructed as an example of the storage portion of the portable apparatus 20 according to this embodiment and can include a storage medium, a recording device for recording data into the storage medium, a read-out device for reading out data from the storage medium and an erasing device for erasing data recorded in the storage medium. The storage device 211 is constituted of, for example, HDD (Hard Disk Drive). This storage device 211 drives a hard disk so as to store a program to be executed by the CPU 201 and various data. Further, this storage device 211 stores content data and retrieval database for retrieving the content data. In the meantime, the storage device 211 or the storage medium may be detachably attached to the portable apparatus 20.

The drive 212 is a reader writer for the storage medium and incorporated in the portable apparatus 20 or attached externally thereto. The drive 212 reads information recorded in a removable storage medium 24 such as a magnetic disk, optical disk, magneto-optical disk or semiconductor memory and outputs it to the RAM 203.

The communication unit 215 is a communication interface constituted of a communication device for connecting to the communication network 12. The communication unit 215 may be a wireless LAN (Local Area Network) correspondence communication unit, wireless USB correspondence communication unit, wired communication unit which executes wired communication or digital radio broadcasting receiving unit. Further, the communication unit 215 may include a TV tuner or an antenna. This communication unit 215 can exchange the content data between the content delivery server 10 and the PC 30 through the communication network 12.

The configuration of the hardware of the portable apparatus 20 according to this embodiment has been described above. Subsequently, the function of the portable apparatus 20 will be described with reference to FIG. 4.

Figure 4:
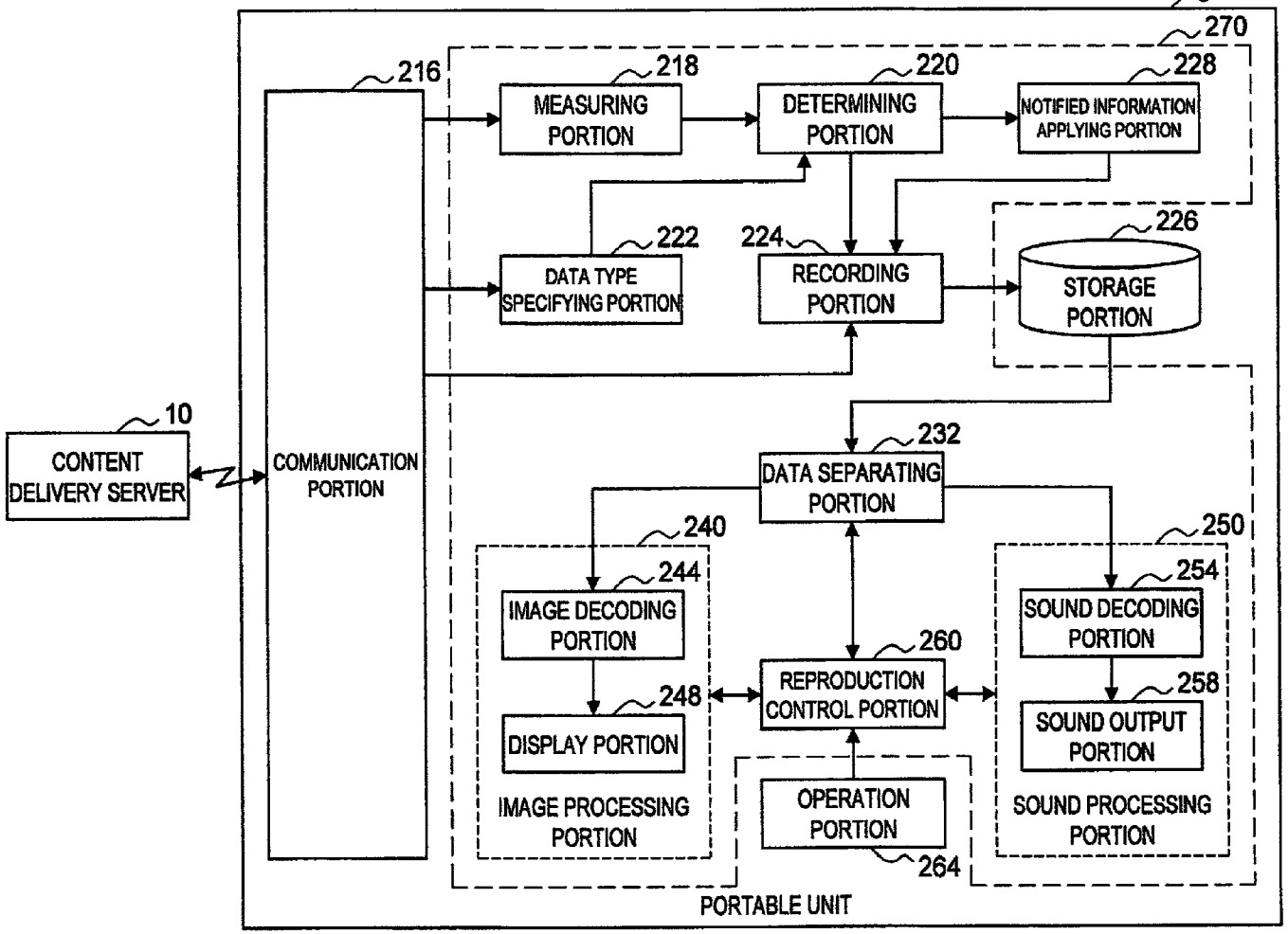
FIG. 4 is a functional block diagram showing the configuration of a portable apparatus according to the first embodiment.

FIG. 4 is a functional block diagram showing the configuration of the portable apparatus 20 according to this embodiment. The portable apparatus 20 includes a communication portion 216, a measuring portion 218, a determining portion 220, a data type specifying portion 222, a recording portion 224, a storage portion 226, a notification information applying portion 228, a data separating portion 232, an image processing portion 240, a sound processing portion 250 and a reproduction control portion 260.

The communication portion 216 is an interface with the content delivery server 10 and has a function as a sending portion or a receiving portion. For example, the communication portion 216 can receive content data such as TV program and movie broadcasted continuously (at real time) using radio wave. The content data to be sent from the content delivery server 10 may be of digital or of analog type.

In the meantime, the communication portion 216 is a software for making the communication device 215 shown in FIG. 3 function and may be the communication unit 215 which operates based on that software. Although FIG. 4 shows a case where the communication portion 216 and the content delivery server 10 communicate directly with each other, the communication portion 216 and the content delivery server 10 may communicate through the communication network 12 as shown in FIG. 1.

The measuring portion 218 measures a signal intensity of the content data received by the communication portion 216. Sometimes, the signal intensity of the content data received by the communication portion 216 may be related to whether or not the received condition of the content data is acceptable. For example, if the signal intensity is high, it can be considered that the received condition of the content data is excellent so that high quality content data is being received. On the other hand, if the signal intensity is low, it can be considered that the received condition of the content data is poor so that the quality of the received content data is low.

The determining portion 220 determines whether or not the received condition of the content data by the communication portion 216 satisfies a predetermined standard. For example, the determining portion 220 determines whether or not the signal intensity measured by the measuring portion 218 exceeds a predetermined threshold. If the determining portion 220 determines that the signal intensity measured by the measuring portion 218 exceeds the predetermined threshold, it instructs the recording portion 224 to record the content data. Further, if the determining portion 220 determines that the signal intensity measured by the measuring portion 218 is lower than the predetermined threshold, it instructs the recording portion 224 to stop the recording of the content data.

That is, if it is determined that the signal intensity exceeds the predetermined threshold by the determining portion 220, the content data is recorded in the storage portion 226 and if it is determined that the signal intensity is lower than the predetermined threshold, no content data is recorded in the storage portion 226.

As described above, the signal intensity affects the quality of the content data. For example, the higher the signal intensity is, the higher the quality of the content data is, and the lower the signal intensity is, the lower the quality of the content data is. Therefore, if a predetermined threshold is set at a border value of the signal intensity which determines whether or not the content data can be watched/listened to, the content data difficult to watch/listen to can be blocked from being recorded in the storage portion 226 based on a determination of the determining portion 220.

The determining portion 220 may determine whether or not the received condition of the content data satisfies a standard based on whether or not an average of the signal intensity measured by the measuring portion 218 exceeds a predetermined threshold. The average of the signal intensity may be calculated according to partitioned average method or moving-average method. If the signal intensity drops temporarily due to a sudden change of the environment, the determining portion 220 determines that the received condition of the content data satisfies the standard and can continue recording of the content data.

The predetermined threshold may be different depending on which the data type of the content data received by the communication portion 216 is video data, sound data or text data. The data type of the content data may be specified by the data type specifying portion 222 described later.

The data type specifying portion 222 specifies the data type of the content data received by the communication portion 216. The data type specifying portion 222 notifies the determining portion 220 of the data type of a specified content data. The determining portion 220 can use a different value as the predetermined threshold of the signal intensity for each of the data types notified from the data type specifying portion 222.

Even if a signal intensity measured by the measuring portion 218 is not an intensity capable of securing the quality of an image, sometimes that intensity can secure the quality of sound. Then, if the content data received by the communication portion 216 is sound data, the determining portion 220 can grasp that the content data is sound data by the data type specifying portion 222 and use the threshold of the signal intensity for sound data as the predetermined threshold.

The recording portion 224 records content data received from the content delivery server 10 by the communication portion 216 in the storage portion 226. In more specific terms, if it is determined that the signal intensity measured by the measuring portion 218 exceeds a predetermined threshold by the determining portion 220, the recording portion 224 records the content data in the storage portion 226. If it is determined that the signal intensity measured by the measuring portion 218 is lower than the predetermined threshold by the determining portion 220, the recording portion 224 does not record content data in the storage portion 226.

In the meantime, the content data received by the communication portion 216 may be data in which data of plural types such as video data, sound data and text data are mixed. Such content data may be compressed to suppress the quantity of communication between the content delivery server 10 and the communication portion 216.

The storage portion 226 has a function as a storage medium which memorizes the content data sent by the content delivery server 10. The content data may be so configured that video data and sound data are mixed. The storage portion 226 may memorize communication information to be recorded by the recording portion 224 described later.

The storage portion 226 may be incorporated in the portable apparatus 20, attached externally thereto or connected detachably. The storage portion 226 may be any storage medium, for example, nonvolatile memory such as EEPROM (Electrically Erasable Programmable Read-Only Memory) and EPRPM (Erasable Programmable Read Only Memory), a magnetic disk such as hard disk and circular magnetic disk, optical disk such as CD-R/RW, DVD-R/RW/+R/+RW/RAM, BD (Blue-Ray Disc (registered trademark)-R/BD-RE, MO (Magneto Optical) disk.

The notification information applying portion 228, when the recording portion 224 stops recording of the content data based on a determination of the determining portion 220, matches notification information indicating that the recording of the content data has been stopped to the content data. For example, when the recording portion 224 stops recording of the content data, the notification information applying portion 228 can insert image information containing characters like "recording is stopped temporarily" or "recording is interrupted" at a predetermined data position in which the recording of the content data is stopped as video notification information.

An example of a process of recording the content data by the determining portion 220 and the recording portion 224 will be described with reference to FIG. 5 and FIG. 6.

Figure 5:
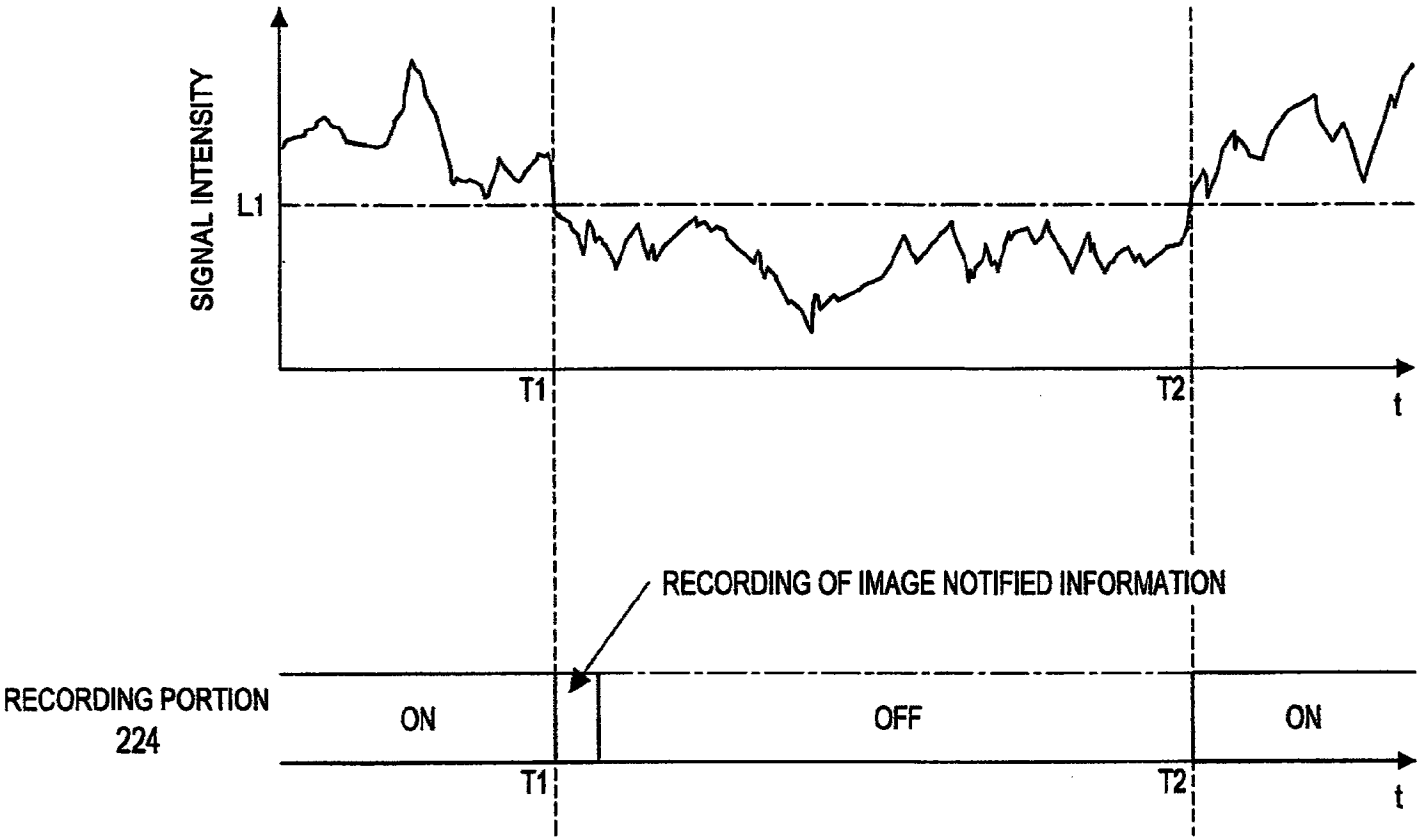
FIG. 5 is an explanatory diagram showing a relationship between a signal intensity and an operation of a recording portion according to the first embodiment.

FIG. 5 is an explanatory diagram showing a relationship between the signal intensity and an operation of the recording portion 224. In the graph shown in FIG. 5, the ordinate axis indicates the intensity of a signal received by the communication portion 216 and measured by the measuring portion 218 while the abscissa axis indicates a time. L1 is a threshold of the signal intensity for determining whether or not the received condition of the content data satisfies a predetermined standard.

In an upper diagram of FIG. 5, the signal intensity measured by the measuring portion 218 is over a threshold L1 up to timing T1, below the threshold L1 from timing T1 to timing T2 and over the threshold L1 after timing T2. Therefore, the determining portion 220 determines that the signal intensity is below the threshold L1 at timing T1 and makes the recording portion 224 stop recording of the content data. A status in which the recording portion 224 records the content data up to timing T1 is expressed with ON in the lower diagram of FIG. 5 and a status in which the recording portion 224 stops recording of the content data after timing T1 is expressed with OFF in a lower diagram of FIG. 5.

The determining portion 220 can determine that the signal intensity exceeds the threshold L1 at timing T2 and make the recording portion 224 restart recording of the content data. A status in which the recording portion 224 restarts recording of the content data at timing T2 is expressed with ON.

The recording portion 224 records video notification information indicating that recording of the content data is stopped at timing T1 in the storage portion 226. Such video notification information may be supplied by the notification information applying portion 228 to the recording portion 224.

Figure 6:
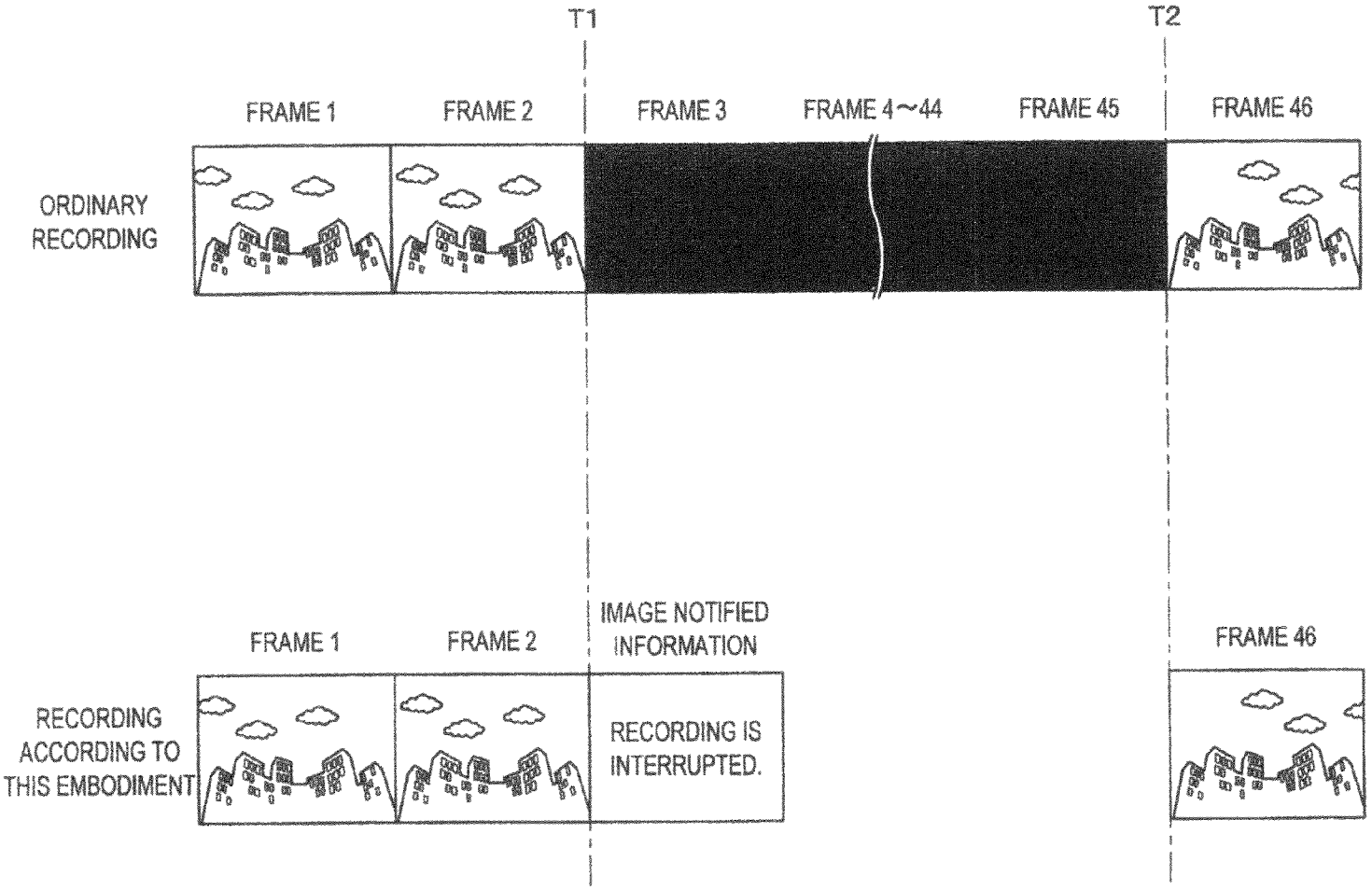
FIG. 6 is an explanatory diagram showing a content data recorded by the recording portion by each image frame.

FIG. 6 is an explanatory diagram showing the content data recorded by the recording portion 224 by each image frame. In more specific terms, the upper diagram of FIG. 6 indicates content data recorded in an ordinary recording method of continuing recording of the content data regardless of the signal intensity, and the lower diagram of FIG. 6 indicates the content data recorded by the recording method according to this embodiment. The timing T1 in FIG. 5 corresponds to a border between frame 2 and frame 3 in FIG. 6 and the timing T2 in FIG. 5 corresponds to a border between frame 45 and frame 46 in FIG. 6.

As shown in the upper diagram of FIG. 6, according to the ordinary recording method, the content data is continued to be recorded regardless of the signal intensity of the content data received by the communication portion 216. As a result, according to the ordinary recording method, frame 1, frame 2 and frame 46 corresponding to the content data received before timing T1 and after timing T2 in which the signal intensity is over the threshold L1 are recorded, and frame 3-frame 45 corresponding to the content data received after timing T1 and before timing T2 in which the signal intensity is below the threshold L1 are recorded. Here, frame 3-frame 45 have a relatively low quality because they are content data received when the signal intensity is below the threshold L1.

To the contrary, the recording portion 224 according to this embodiment does not record frame 3-frame 45 having a low quality corresponding to the content data received between timing T1 and timing T2 in which the signal intensity is lower than the threshold L1 as shown in the lower diagram of FIG. 6. On the other hand, the recording portion 224 records frame 1, frame 2 and frame 46 corresponding to the content data received before timing T1 and after timing T2 in which the signal intensity is over the threshold L1 in the storage portion 226. The recording portion 224 can record sound data corresponding to each frame in the storage portion 226.

According to this embodiment, if the signal intensity of received content data is below the predetermined threshold, the determining portion 220 determines that the predetermined standard is not satisfied and instructs the recording portion 224 to stop recording of the content data. Thus, this can suppress the recording portion 224 from recording content data difficult to watch/listen to in the storage portion 226. As a result, the portable apparatus 20 according to this embodiment can use the storage capacity of the storage portion 226 effectively.

If the recording of the content data is stopped as shown in the lower diagram of FIG. 6, the recording portion 224 records video notification information at a recording stop position in cooperation with the notification information applying portion 228. For example, the video notification information may be an image containing text information saying "recording is stopped temporarily" or an image containing photograph or special characters as shown in the lower diagram of FIG. 6.

The recording portion 224 records the video notification information in the storage portion 226 when recording of the content data is stopped. Thus, when reproduction position of the content data arrives at a recording stop position of the content data, the portable apparatus 20 can reproduce video notification information, for example, saying "recording is stopped temporarily" without any special processing.

Returning to description of the structure of the portable apparatus 20 with reference to FIG. 4, the data separating portion 232 separates video data and sound data contained in the content data stored in the storage portion 226. Then, the data separating portion 232 outputs the separated video data to the video processing portion 240 and outputs the separated sound data to the sound processing portion 250.

The video processing portion 240 includes a video decoding portion 244 and a display portion 248. The video decoding portion 244 decodes video data inputted from the data separating portion 232. For example, the video decoding portion 244 can decode video data of such data type as JPEG (Joint Photographic Coding Experts Group), MPEG (Moving Picture Experts Group) 1, MPEG2 or MPEG4.

The display portion 248 displays video data decoded by the video decoding portion 244. The display portion 248 may be, for example, a liquid crystal display corresponding to the display portion 21 shown in FIG. 2 or the output unit 210 shown in FIG. 3.

The sound processing portion 250 includes the sound decoding portion 254 and the sound output portion 258. The sound decoding portion 254 decodes sound data inputted from the data separating portion 232. For example, the sound decoding portion 254 can decode sound data of such data type as MP3 (MPEG1 Layer-3), AAC (Advanced Audio Codec), LPCM (Linear PCM), WMA9 (Windows Media Audio 9), ATRAC (Adaptive Transform Acoustic Coding) or ATRAC 3.

The sound output portion 258 outputs sound data decoded by the sound decoding portion 254. The sound output portion 258 may be, for example, earphone or headphone corresponding to the sound output portion 22 shown in FIG. 2 or the output unit 210 shown in FIG. 3.

Figure 7:
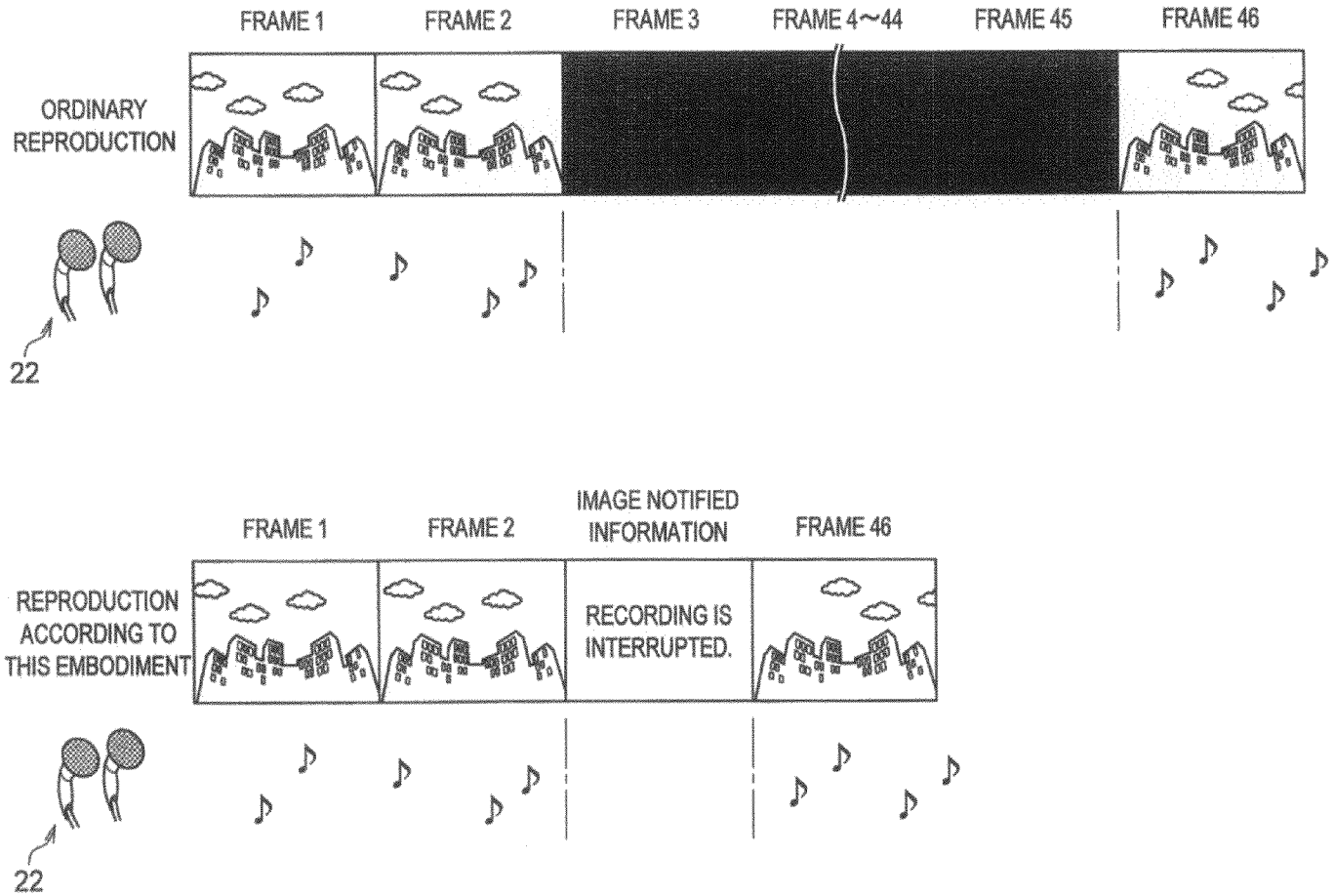
FIG. 7 is an explanatory diagram showing a status of reproduction of the content data in the portable apparatus according to the first embodiment.

The video processing portion 240 and sound processing portion 250 having a function as such a reproducing portion reproduces the content data recorded in the storage portion 226 as shown in FIG. 7.

FIG. 7 is an explanatory diagram showing a status of reproduction of the content data in the portable apparatus 20 according to this embodiment. The upper diagram of FIG. 7 shows a status in which the content data recorded in an ordinary recording method is reproduced, and the lower diagram of FIG. 7 shows a status in which the content data recorded by the recording portion 224 according to this embodiment is reproduced. Further, FIG. 7 shows a case of reproducing the content data recorded in the storage portion 226 shown in FIG. 6.

As shown in the upper diagram of FIG. 7, the content data recorded according to the ordinary recording method is reproduced including a portion difficult to watch/listen to. More specifically, frame 3-frame 45 having an inferior quality or filled with black are displayed. While frame 3-frame 45 are displayed, sound containing much noise is outputted or no sound is produced. The ordinary recording method has such an issue that user has no way for knowing until when the content data difficult to watch/listen to will be reproduced or is forced to execute rapid feeding operation for avoiding reproduction of the content data difficult to watch/listen to.

Contrary to this, the recording portion 224 according to this embodiment can record the content data by suppressing data amount of a portion difficult to watch/listen to of the content data. Thus, in the portable apparatus 20, as shown in the lower diagram of FIG. 7, the content data and video notification information having an excellent quality are reproduced and the content data difficult to watch/listen to is not reproduced. More specifically, frame 1, frame 2, frame 46 corresponding to the content data received under the signal intensity exceeding the threshold L1 and video notification information, and sound corresponding to frame 1, frame 2 and frame 46 are reproduced.

Thus, this embodiment can solve the issue that user has no way for knowing until when the content data difficult to watch/listen to will be reproduced and user is forced to execute rapid feed operation in order to avoid reproduction of the content data difficult to watch/listen to. The portable apparatus 20 according to this embodiment can suppress the data amount of a portion difficult to watch/listen to of the content data recorded in the storage portion 226 so as to use the data capacity of the storage portion 226 effectively.

Because when the reproduction position of the content data reaches a recording stop position of the content data, the video notification information indicating that recording of the content data is stopped without necessity of any special processing is displayed, user can grasp that recording of the content data is stopped at a data position just before the video notification information is displayed.

Just the video notification information is indicated as an example of the notification information above, and the notification information may be sound notification information indicating that recording of the content data is stopped. If the recording portion 224 records the sound notification information at a recording stop position of the content data as an example of the notification information, the video processing portion 240 and the sound processing portion 250 reproduce the content data as described below.

Figure 8:
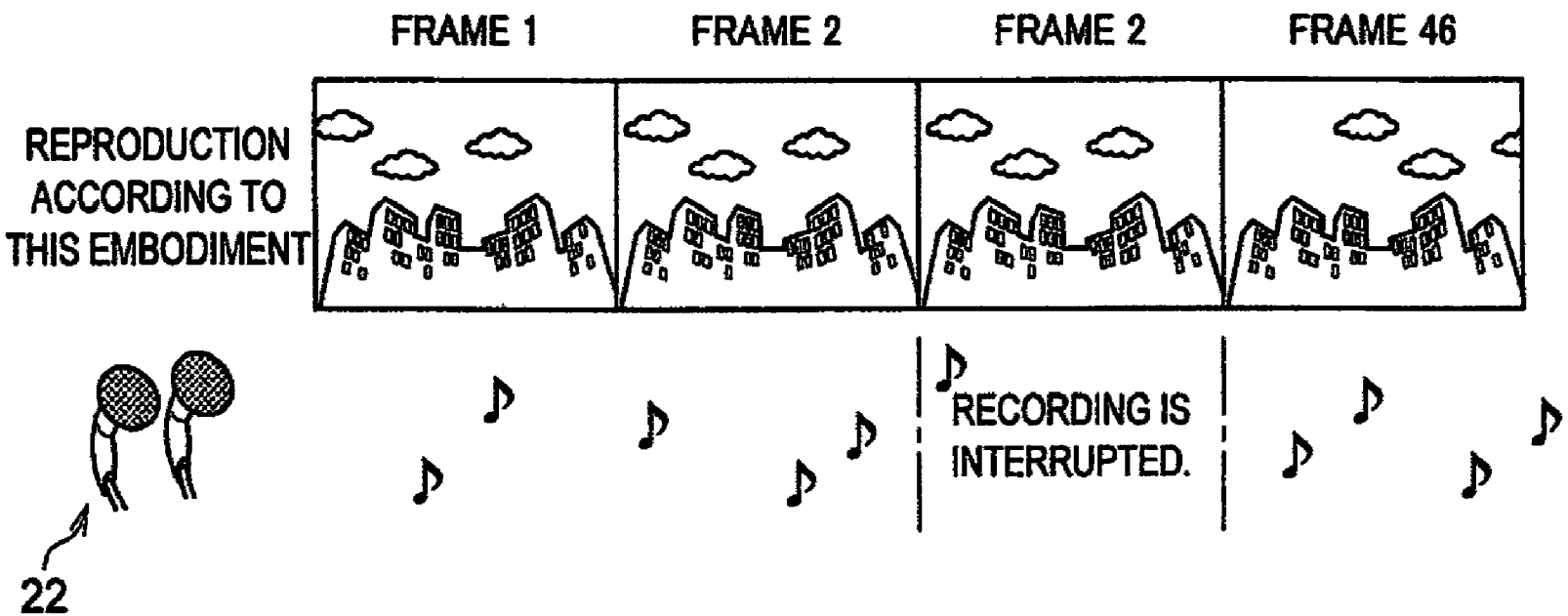
FIG. 8 is an explanatory diagram showing a status of reproduction of the content data in case where sound notification information is recorded during a stop of recording of the content data.

FIG. 8 is an explanatory diagram showing a status of reproduction of the content data in case where sound notification information is recorded at a recording stop position of the content data. The recording portion 224 records sound notification information saying that recording of the content data is stopped at a recording stop position of the content data in cooperation with the notification information applying portion 228. For example, if the recording portion 224 records sound notification information saying "recording is stopped temporarily" at the recording stop position of the content data, as shown in FIG. 8, the sound notification information saying "recording is stopped temporarily" is reproduced at the recording stop position of the content data.

User can grasp that recording of the content data is stopped temporarily by hearing such sound notification information. Because the sound notification information can have a smaller data amount than the video notification information, using of the sound notification information as notification information is effective from viewpoints of effective use of the storage capacity of the storage portion 226.

Although FIG. 8 shows an example that when content data of frame 3-frame 45 is recorded, frame 2 which is a frame just before the sound notification information is reproduced, frame 46 may be displayed while the sound notification information is reproduced or it is permissible to block any image from being displayed while the sound notification information is reproduced.

The notification information is not restricted to the video notification information or sound notification information recorded at the recording stop position of the content data but may be meta data which contains information relating to recording stop of the content data and is recorded in correspondence to the content data. An example of the meta data will be described with reference to FIG. 9.

FIG. 9 is an explanatory diagram showing an example of meta data containing information relating to the recording stop of the content data. The meta data includes content ID, title, genre, recording date, whether or not recording stop occurs, and recording stop period.

The content ID is identification information which is provided to each content data inherently, indicating any content data. Therefore, the meta data shown in FIG. 9 is meta data relating to the content data whose content ID is "14114411".

The title is a tile of the content data indicated with the content ID. FIG. 9 shows a case where the title of the content data whose content ID is "14114411" is "elementary school science—movement of clouds".

Genre indicates a section corresponding to a content of content data indicated by the content ID. The genre may be, for example, sports, news, drama, movie or variety program. FIG. 9 shows a case where the genre of the content data whose content ID is "14114411" is "education".

The recording date indicates date when the recording portion 224 records the content data expressed with the content ID in the storage portion 226. FIG. 9 indicates a case where the content data whose content ID is "14114411" is recorded in the storage portion 226 on Jan. 4, 2007.

Whether or not recording stop occurs is information indicating whether or not recording of the content data indicated with the content ID into the storage portion 226 is stopped. That is, if the recording portion 224 determines that the recording of the content data is stopped based on a determination of the determining portion 220, it may be determined that the recording stop occurs and unless recording of the content data is stopped by the recording portion 224, it may be determined that no recording stop occurs. FIG. 9 indicates that the recording of the content data whose content ID is "14114411" is stopped.

The recording stop period is stop information indicating a data range in which recording of the content data indicated by the content ID into the storage portion 226 is stopped. FIG. 9 indicates a case where recording of the content data whose content ID is "14114411", is stopped between timing T1 and timing T2. In the meantime, timing T1 and timing T2 may be information indicating a period with a start timing of the content data as a criterion. More specifically, if recording of the content data is stopped when 12 minutes elapse since content data whose reproduction time is an hour is started and the recording of the content data is restarted when 40 minutes elapse since the content data is started, timing T1 corresponds to 12 minutes while timing T2 corresponds to 40 minutes.

The recording portion 224 can record the meta data shown in FIG. 9 in the storage portion 226 as notification information in correspondence with the content data in cooperation with the notification information applying portion 228. The reproduction control portion 260 shown in FIG. 4 can control so that any special image and sound are reproduced based on the meta data when reproducing the content data to which the meta data is matched.

The reproduction control portion 260 refers to the information about whether recording stop occurs, contained in the meta data matched to the content data when reproducing the content data. Then, if the recording stop occurs, the reproduction control portion 260 refers to the recording stop period and extracts a timing when the recording of the content data is stopped. If the content data is reproduced up to the extracted timing, image information and sound information saying that the recording of the content data is stopped at that timing are reproduced. In the meantime, the image information and sound information indicating that the recording of the content data is stopped may be memorized in the storage portion 226 preliminarily.

If the meta data shown in FIG. 9 is matched to the content data, when the content data is reproduced up to timing T1, the reproduction control portion 260 can control the display portion 248 to display image information indicating that the recording of the content data is stopped. Further, when the content data is reproduced up to timing T1, the reproduction control portion 260 can control the sound output portion 258 to output sound information indicating that recording of the content data is stopped in a period from timing T1 to timing T2.

With such a structure, because the data capacity needed for the meta data is smaller than video information and sound information, the storage capacity of the storage portion 226 for use for notification information can be suppressed.

Even if the display portion 248 is so constructed to display that recording of the content data is stopped while the recording portion 224 refrains from recording of the content data based on a determination of the determining portion 220, the sound output portion 258 may be so constructed to output a sound saying that recording of the content data is stopped. The display portion 248 and the sound output portion 258 function as a notification portion for notifying user that recording of the content data is stopped.

Hereinafter, the configuration and function of the portable apparatus 20 according to this embodiment will be described. The information processing portion 270 including the measuring portion 218, determining portion 220, data type specifying portion 222, recording portion 224, notification information applying portion 228, data separating portion 232, video processing portion 240, sound processing portion 250 and reproduction control portion 260 schematically expresses processing to be executed by hardware such as the CPU 201 described referring to FIG. 3 or its internal configuration. In the meantime, the function of the information processing portion 270 can be mounted on one or two or more integrated circuits. The same thing can be said of the information processing portion 270 of the second embodiment and the third embodiment. Subsequently, the recording method by the portable apparatus 20 according to this embodiment will be described with reference to FIG. 10.

Figure 10:
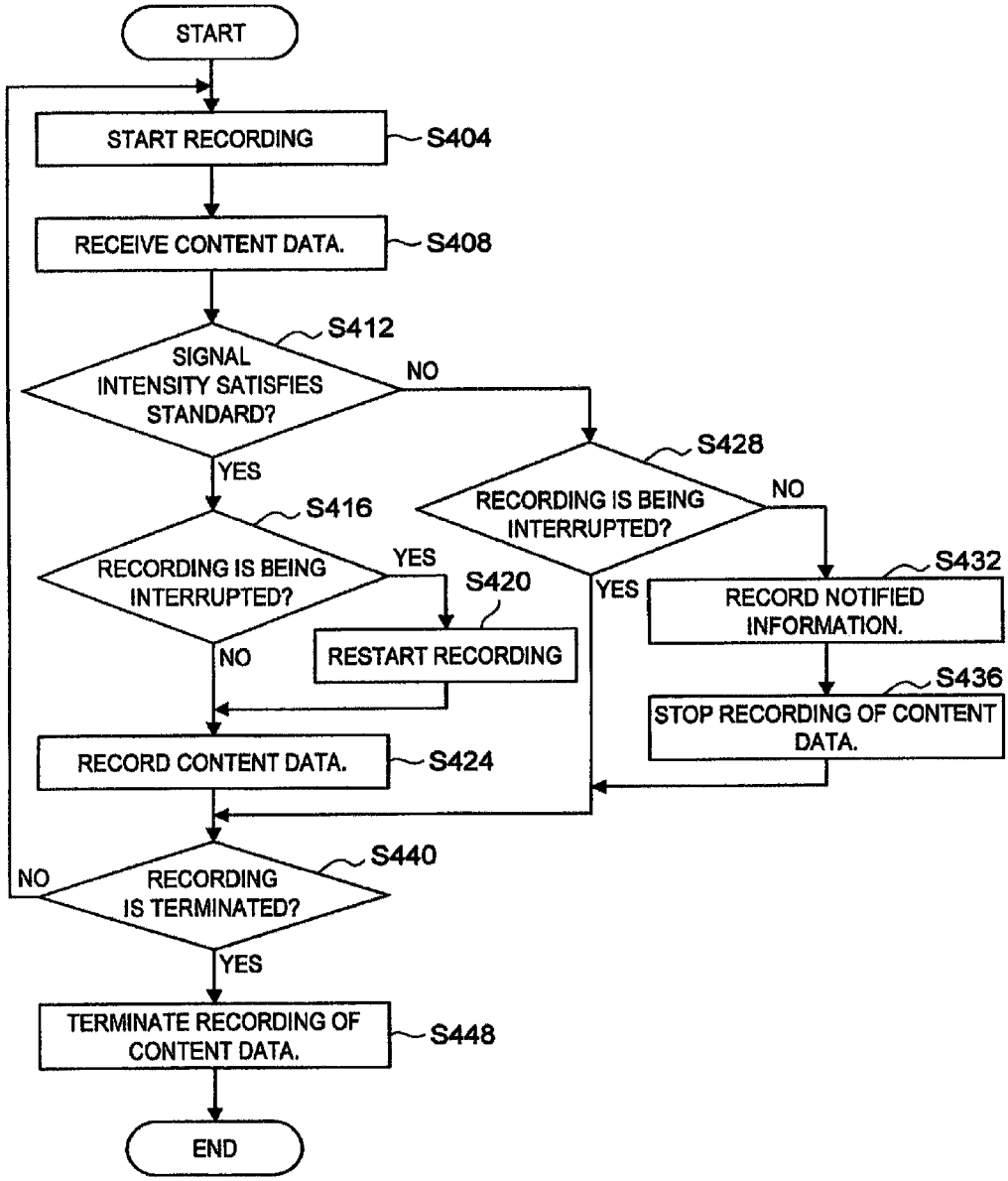
FIG. 10 is a flow chart showing a flow of recording method of the content data by the portable apparatus according to the first embodiment.

FIG. 10 is a flow chart showing a flow of the recording method by the portable apparatus 20 according to this embodiment. First, the portable apparatus 20 starts recording of the content data automatically or manually (S404). A case where recording is started manually can include a case where the recording start button for instructing recording of the content data which user is watching/listening to now is pressed. Further, a case where recording is automatically started can include a case where user specifies a content data to be recorded using EPG (Electronic Program Guide) preliminarily or a case where user specifies a recording start time and a recording termination time preliminarily.

Subsequently, the portable apparatus 20 receives content data (S408). Then, the portable apparatus 20 determines whether or not the signal intensity of the received content data satisfies a predetermined standard (S412). If it is determined that the signal intensity of the received content data satisfies the predetermined standard, the portable apparatus 20 determines whether or not recording of the content data is being stopped (S416). If recording of the content data is being stopped, the portable apparatus 20 restarts recording of the content data and records the received content data (S420, S424) and unless recording of the content data is being stopped, the received content data is continued to be recorded (S424).

After that, the portable apparatus 20 determines whether or not recording of the content data is terminated (S440). The portable apparatus 20 determines that recording of the content data is terminated, for example, when a specified time is reached or user's operation of terminating recording of the content data is carried out (S440). If the portable apparatus 20 determines that recording of the content data is not terminated, the procedure returns to processing of S408.

If it is determined that the signal intensity of the received content data does not satisfy the predetermined standard in S412, the portable apparatus 20 determines whether or not recording of the content data is being stopped (S428). If the portable apparatus 20 determines that the recording of the content data is being stopped, the procedure proceeds to processing of S440.

On the other hand, if it is determined that the recording of the content data is not being stopped in S428, the portable apparatus 20 records notification information concerning the recording stop of the content data (S432). Subsequently, the portable apparatus 20 stops recording of the content data and the procedure proceeds to processing of S440 (S436). Then, if it is determined that recording of the content data is terminated in S440, the portable apparatus 20 terminates recording of the content data (S448).

The portable apparatus 20 may bring the video processing portion 240 and the sound processing portion 250 into non-operating status during recording of the content data. When recording of the content data is terminated, the portable apparatus 20 may turn OFF power of the portable apparatus 20. Further, if recording of the content data is started when the portable apparatus 20 turns ON power, a function of receiving the content data may be performed automatically.

As described above, if it is determined that the received condition of the content data does not satisfy the predetermined standard by the determining portion 220, the recording portion 224 of the portable apparatus 20 of the first embodiment of the present invention stops recording of the content data to the storage portion 226. Here, if the determining portion 220 is configured to determine that if the signal intensity of the received content data is lower than the predetermined threshold L1, the recording portion 224 can be blocked from recording a content data having an inferior quality from being recorded in the storage portion 226. As a result, the storage capacity of the storage portion 226 can be used effectively.

If the recording of the content data is stopped based on determination by the determining portion 220, the recording portion 224 indicates that the recording of the content data is stopped and records notification information capable of specifying a data position in which the recording is stopped in the storage portion 226. Therefore, user can grasp whether or not the recording of the content data is stopped based on such notification information.

Second Embodiment

Next, a portable apparatus 40 according to the second embodiment of the present invention will be described. The portable apparatus 20 according to the first embodiment determines whether or not recording is stopped using only the threshold of one signal intensity to one content data. However, sometimes plural kinds of data such as video data and sound data are contained in one content data so that the thresholds of the signal intensities which disable watching/listening are different depending on the data type. In this case, if determination about stop of the recording is carried out using only the threshold of one signal intensity to one content data, no optimum determination concerning the stop of the recording can be carried out to various kinds of data. As a result, the signal intensity is not an intensity capable of securing the quality of video data even if the signal intensity is of an intensity capable of securing the quality of sound data, there can be generated a case where the portable apparatus 20 records no video data or no sound data.

Accordingly, by taking the above-described circumstance into account, creation of the portable apparatus 40 according to the second embodiment of the present invention has been reached. The portable apparatus according to this embodiment can determine whether or not the content data is recorded by each data type contained in the content data. For example, if it is determined that the quality of the sound data can be secured, the portable apparatus 40 according to this embodiment can record sound data regardless of whether or not the quality of the video data can be secured. Hereinafter, the configuration and operation of the portable apparatus 40 will be described with reference to FIG. 11-FIG. 13. In the meantime, description about the same configuration as that described in the first embodiment is omitted while like reference numerals are attached thereto.

Figure 11:
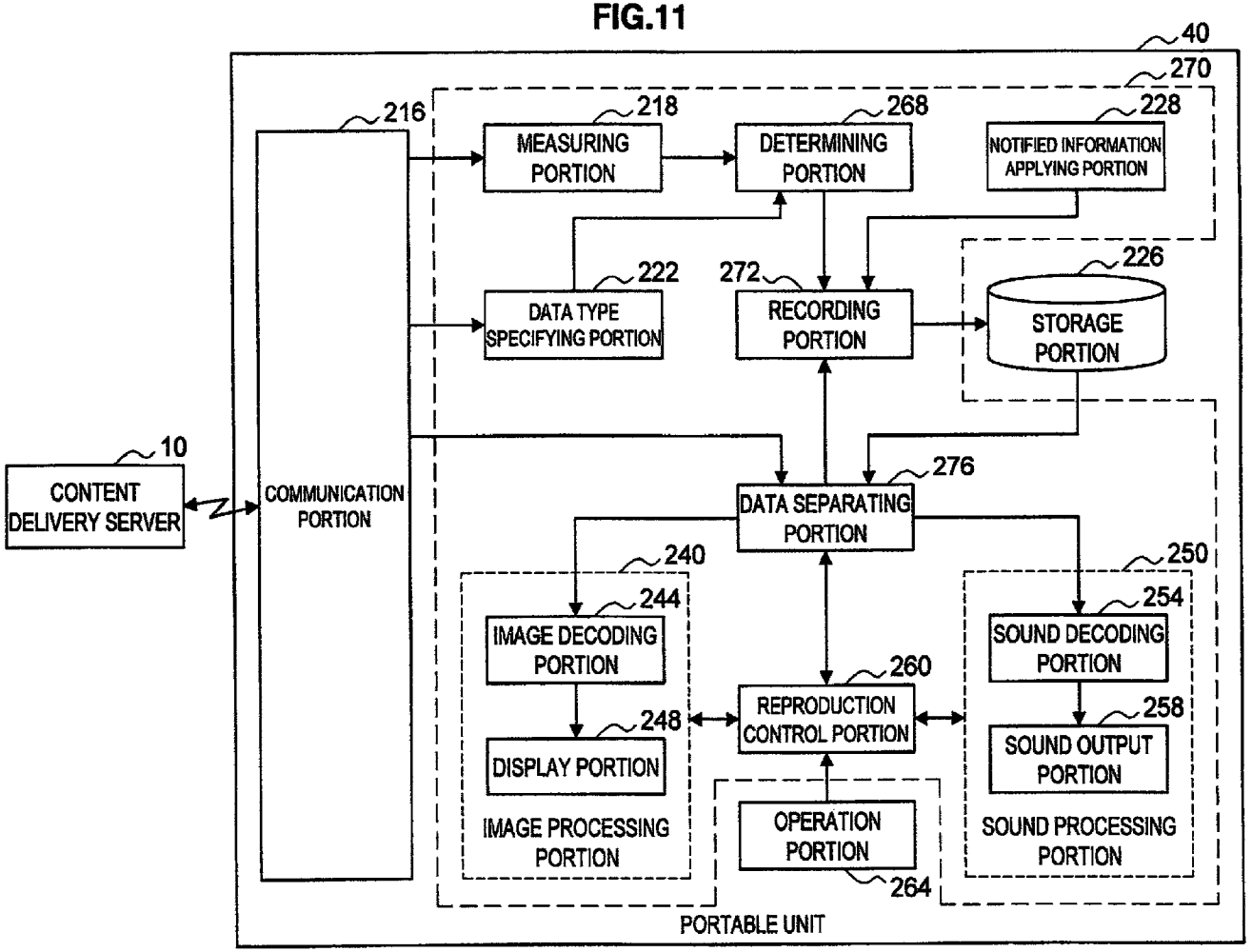
FIG. 11 is a functional block diagram showing the configuration of the portable apparatus according to a second embodiment of the present invention.

FIG. 11 is a functional block diagram showing the configuration of the portable apparatus 40 according to this embodiment. The portable apparatus 40 includes the communication portion 216, measuring portion 218, storage portion 226, notification information applying portion 228, video processing portion 240, sound processing portion 250, reproduction control portion 260, determining portion 268, recording portion 272 and data separating portion 276.

The determining portion 268 according to this embodiment determines whether or not the signal intensity measured by the measuring portion 218 satisfies a standard for recording video data contained in the content data and whether or not it satisfies a standard for recording sound data contained in the content data. Then, if the determining portion 268 determines that the signal intensity measured by the measuring portion 218 satisfies a standard for recording the video data contained in the content data, it instructs the recording portion 272 to record the video data contained in the content data. If the determining portion 268 determines that the signal intensity measured by the measuring portion 218 satisfies a standard for recording the sound data contained in the content data, it instructs the recording portion 272 to record sound data contained in the content data.

The recording portion 272 records the content data received by the communication portion 216 in the storage portion 226 based on a determination of the determining portion 268. If it is determined that the signal intensity satisfies the standard for recording video data contained in the content data by the determining portion 268, the recording portion 272 records the video data contained in the content data in the storage portion 226. If it is determined that the signal intensity satisfies the standard for recording sound data contained in the content data by the determining portion 268, the recording portion 272 records the sound data contained in the content data in the storage portion 226.

When recording of the video data contained in the content data is stopped, the recording portion 272 can record, for example, video notification information in the storage portion 226 in cooperation with the notification information applying portion 228. Likewise, when recording of the sound data contained in the content data is stopped, the recording portion 272 can record, for example, sound notification information in the storage portion 226 in cooperation with the notification information applying portion 228.

The data separating portion 276 separates the content data received by the communication portion 216 by each data type contained in the content data. For example, if the content data received by the communication portion 216 is mixture data of video data and sound data, the data separating portion 276 separates the content data to video data and sound data. Then, the data separating portion 276 outputs the separated data to the recording portion 272.

Hereinafter, a status in which the portable apparatus 40 according to this embodiment records the content data will be described in detail with reference to FIG. 12.

Figure 12:
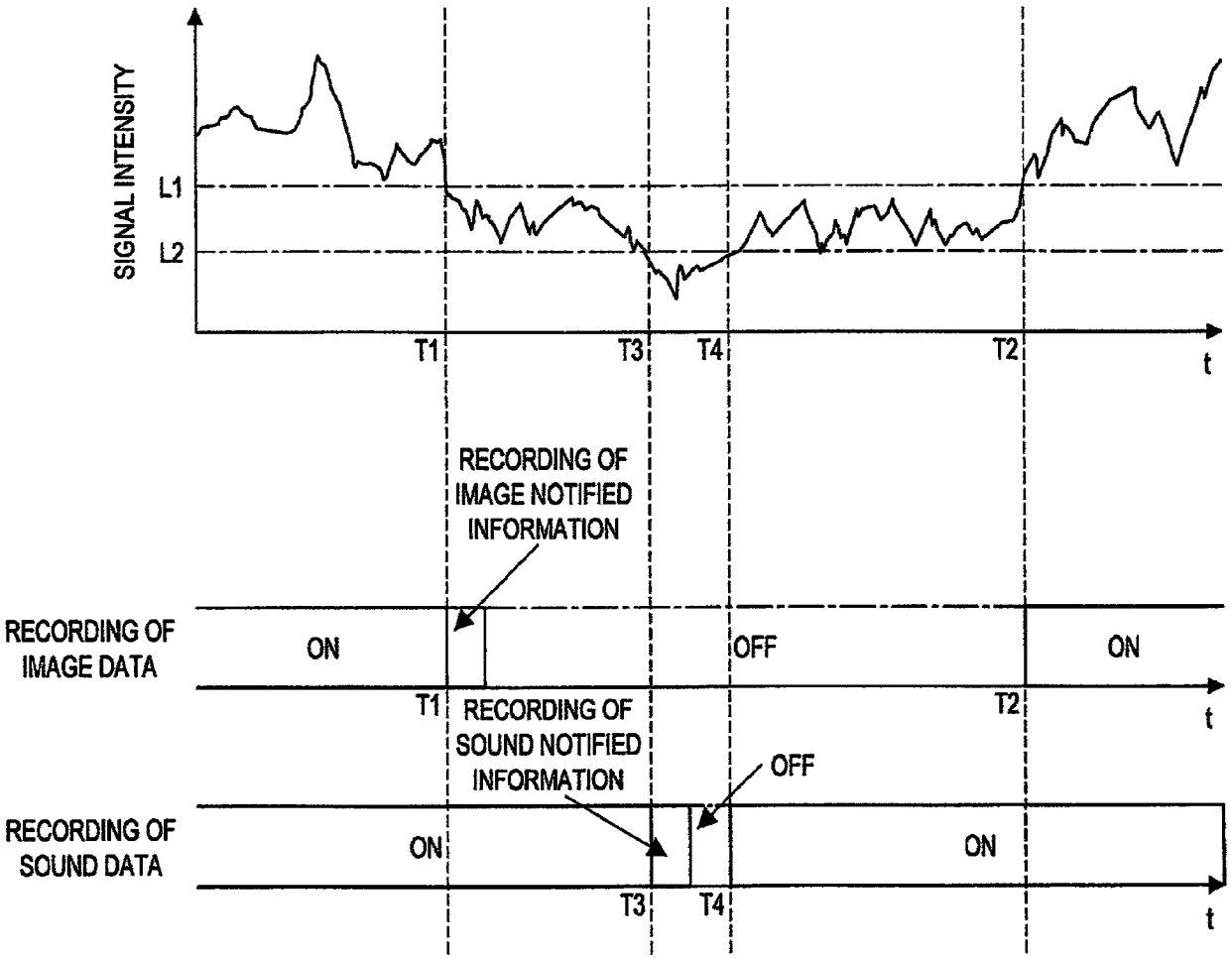
FIG. 12 is an explanatory diagram showing a relation between a signal intensity and an operation of a recording portion according to the second embodiment.

FIG. 12 is an explanatory diagram showing a relationship between the signal intensity and operation of the recording portion 272. In a graph shown in FIG. 12, the ordinate axis indicates the intensity of signal received by the communication portion 216 and measured by the measuring portion 218 and the abscissa axis indicates a time. L1 is a threshold of the signal intensity for the determining portion 268 to determine whether or not the received condition of the content data satisfies the standard for recording video data contained in the content data. L2 is a threshold of the signal intensity for the determining portion 268 to determine whether or not the received condition of the content data satisfies the standard for recording sound data contained in the content data.

Referring to FIG. 12, the signal intensity measured by the measuring portion 218 is over the threshold L1 up to timing T1, below the threshold L1 from timing T1 to timing T2 and over the threshold L1 after timing T2. Therefore, the determining portion 268 determines that the signal intensity is below the threshold L1 at timing T1 and makes the recording portion 272 stop recording of the video data contained in the content data. A status in which the recording portion 272 records the video data contained in the content data up to timing T1 is expressed with ON in an intermediate diagram of FIG. 12 and a status in which the recording portion 272 stops recording of the video data contained in the content data after timing T1 is expressed with OFF in the intermediate diagram of FIG. 12.

The determining portion 268 determines that the signal intensity exceeds the threshold L1 at timing T2 and makes the recording portion 272 restart recording of the video data contained in the content data. A status in which the recording portion 272 restarts recording of the content data at timing T2 is expressed with ON in the intermediate diagram of FIG. 12.

The recording portion 272 records video notification information indicating that recording of the video data contained in the content data is stopped at timing T1. Such video notification information may be supplied by the notification information applying portion 228 to the recording portion 224.

In FIG. 12, the signal intensity measured by the measuring portion 218 is over a threshold L2 up to timing T3, below the threshold L2 from timing T3 to timing T4 and over the threshold L2 after timing T4. Thus, the determining portion 268 determines that the signal intensity is below the threshold L2 at timing T3 and makes the recording portion 272 stop recording of the sound data contained in the content data. A status in which the recording portion 272 records the sound data contained in the content data up to timing T3 is expressed with ON in the lower diagram of FIG. 12, and a status in which the recording portion 272 stops recording of the sound data contained in the content data is expressed with OFF in the lower diagram of FIG. 12.

The determining portion 268 can determine that the signal intensity exceeds the threshold L2 at timing T4 and make the recording portion 272 restart recording of the sound data contained in the content data. A status in which the recording portion 272 restarts recording of the content data at timing T4 is expressed with ON in the lower diagram of FIG. 12.

The recording portion 272 records sound notification information indicating that recording of the sound data contained in the content data is stopped in the storage portion 226 at timing T3. Such sound notification information may be supplied to the recording portion 224 by the notification information applying portion 228.

The configuration of the portable apparatus 40 of the second embodiment which is different from the portable apparatus 20 of the first embodiment has been described. Subsequently, the operation of the portable apparatus 40 according to this embodiment will be described with reference to FIG. 13.

Figure 13:
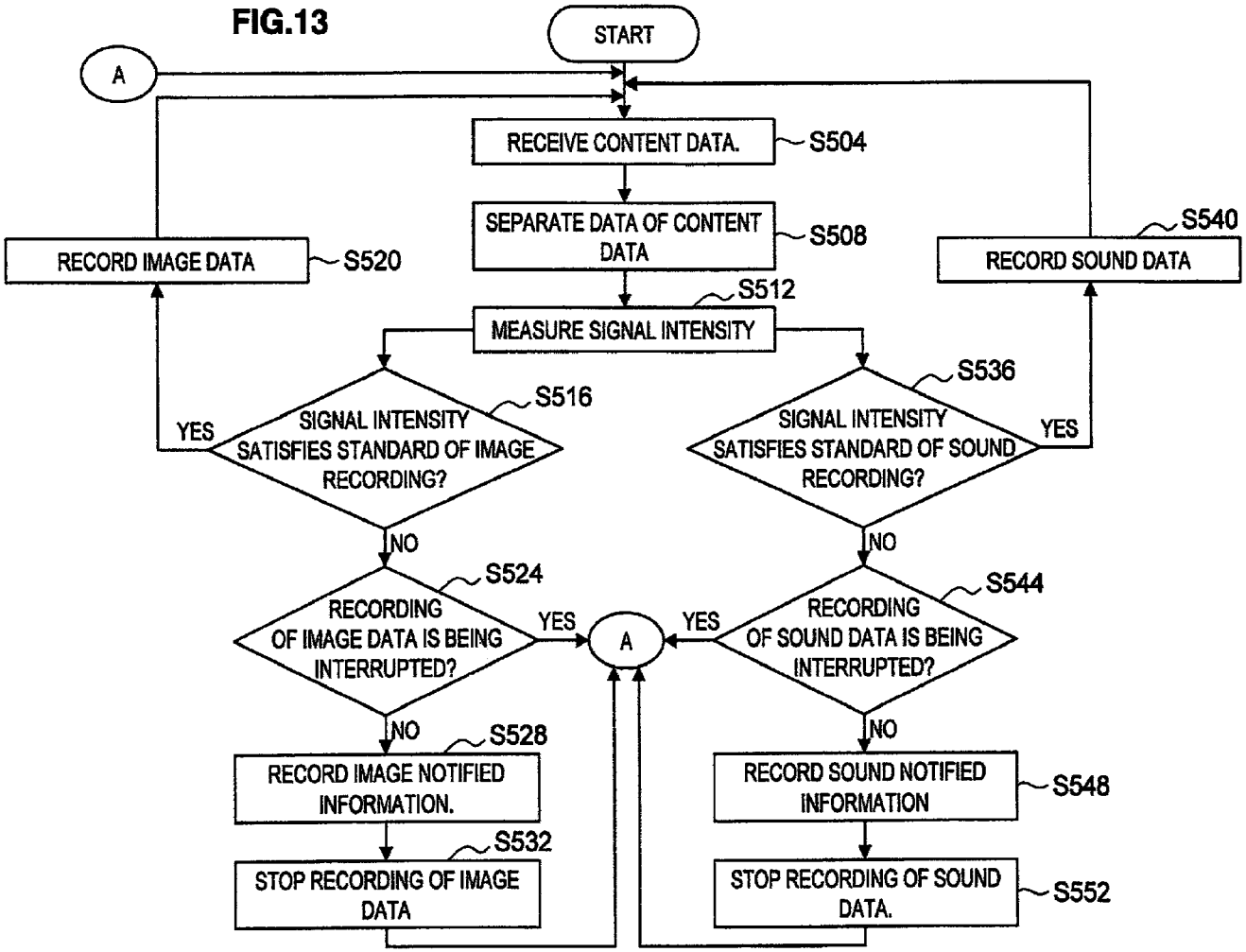
FIG. 13 is a flow chart showing a flow of recording method of the content data by the portable apparatus according to the second embodiment.

FIG. 13 is a flow chart showing a flow of the recording method by the portable apparatus 40 according to this embodiment. First, the communication portion 216 of the portable apparatus 40 receives the content data from an external unit such as the content delivery server 10 and the PC 30 through the communication network 12 (S504). Subsequently, the data separating portion 276 of the portable apparatus 40 separates the content data received by the communication portion 216 to video data and sound data (S508).

Next, the measuring portion 218 of the portable apparatus 40 measures the signal intensity of the content data received by the communication portion 216 (S512). After that, the determining portion 268 of the portable apparatus 40 determines whether or not the signal intensity measured by the measuring portion 218 is over the threshold of the signal intensity for recording video data (S516). When it is determined that the signal intensity measured by the measuring portion 218 is over the threshold of the signal intensity for recording video data by the determining portion 268, the recording portion 272 of the portable apparatus 40 records video data contained in the content data separated by the data separating portion 276 in the storage portion 226 (S520).

On the other hand, if it is determined that the signal intensity measured by the measuring portion 218 is below the threshold of the signal intensity for recording the video data by the determining portion 268 in S516, the determining portion 268 determines whether or not recording of the video data is being stopped currently (S524). If it is determined that recording of the video data is being stopped currently by the determining portion 268, the procedure returns to processing of S504.

On the other hand, if it is determined that video data is being recorded currently by the determining portion 268 in S524, the recording portion 272 records video notification information in the storage portion 226 in cooperation with the notification information applying portion 228 (S528). After that, the recording portion 272 stops recording of video data and the procedure returns to S504 (S532).

After the measurement processing of the signal intensity shown in S512, the determining portion 268 determines whether or not the signal intensity measured by the measuring portion 218 is over the threshold of the signal intensity for recording the sound data (S536). If it is determined that the signal intensity measured by the measuring portion 218 is over the threshold of the signal intensity for recording sound data by the determining portion 268, the recording portion 272 of the portable apparatus 40 records the sound data contained in the content data separated by the data separating portion 276 in the storage portion 226 (S540).

On the other hand, if it is determined that the signal intensity measured by the measuring portion 218 is below the threshold of the signal intensity for recording sound data by the determining portion 268, the determining portion 268 determines whether or not recording of sound data is being stopped currently (S544). If it is determined that the recording of the sound data is being stopped currently by the determining portion 268, the procedure returns to processing of S504.

On the other hand, if it is determined that the sound data is being recorded currently by the determining portion 268, the recording portion 272 records sound notification information in the storage portion 226 in cooperation with the notification information applying portion 228 (S548). After that, the recording portion 272 stops recording of the sound data and the procedure returns to processing of S504 (S552).

As described above, the portable apparatus 40 of the second embodiment of the present invention determines whether or not the received condition of the content data satisfies the standard for each of the data types contained in the content data and can record the content data by each data type contained in the content data. Therefore, the portable apparatus 40 according to this embodiment can record only the sound data if the signal intensity of the received content data is of an intensity capable of securing the quality of the sound data even if it is not an intensity capable of securing the quality of video data. As a result, a portion capable of outputting sound from the content data can be produced even if no image can be displayed, so that user can acquire much information from the content data.

Third Embodiment

Next, a portable apparatus 60 of the third embodiment of the present invention will be described. The portable apparatus 20 of the first embodiment can hardly reproduce a data range not recorded corresponding to the received condition of the content data. Thus, if user desires to reproduce a complete content data, a method for making the portable apparatus 20 receive all data of the content data again can be considered. However, if the portable apparatus 20 is made to receive all data of the content data although there is a portion recorded properly, communication cost, communication amount and communication time increase, which is an issue to be solved.

Accordingly, by taking the above-described circumstances into account, creation of the portable apparatus 60 according to this embodiment has been reached. The portable apparatus 60 according to this embodiment can replenish a portion of the content data not recorded because the received condition does not satisfy the standard effectively. Hereinafter, the configuration and operation of the portable apparatus 60 according to this embodiment will be described with reference to FIG. 14 and FIG. 15. In the meantime, description about the same configuration as that described in the first embodiment is omitted while like reference numerals are attached thereto.

Figure 14:
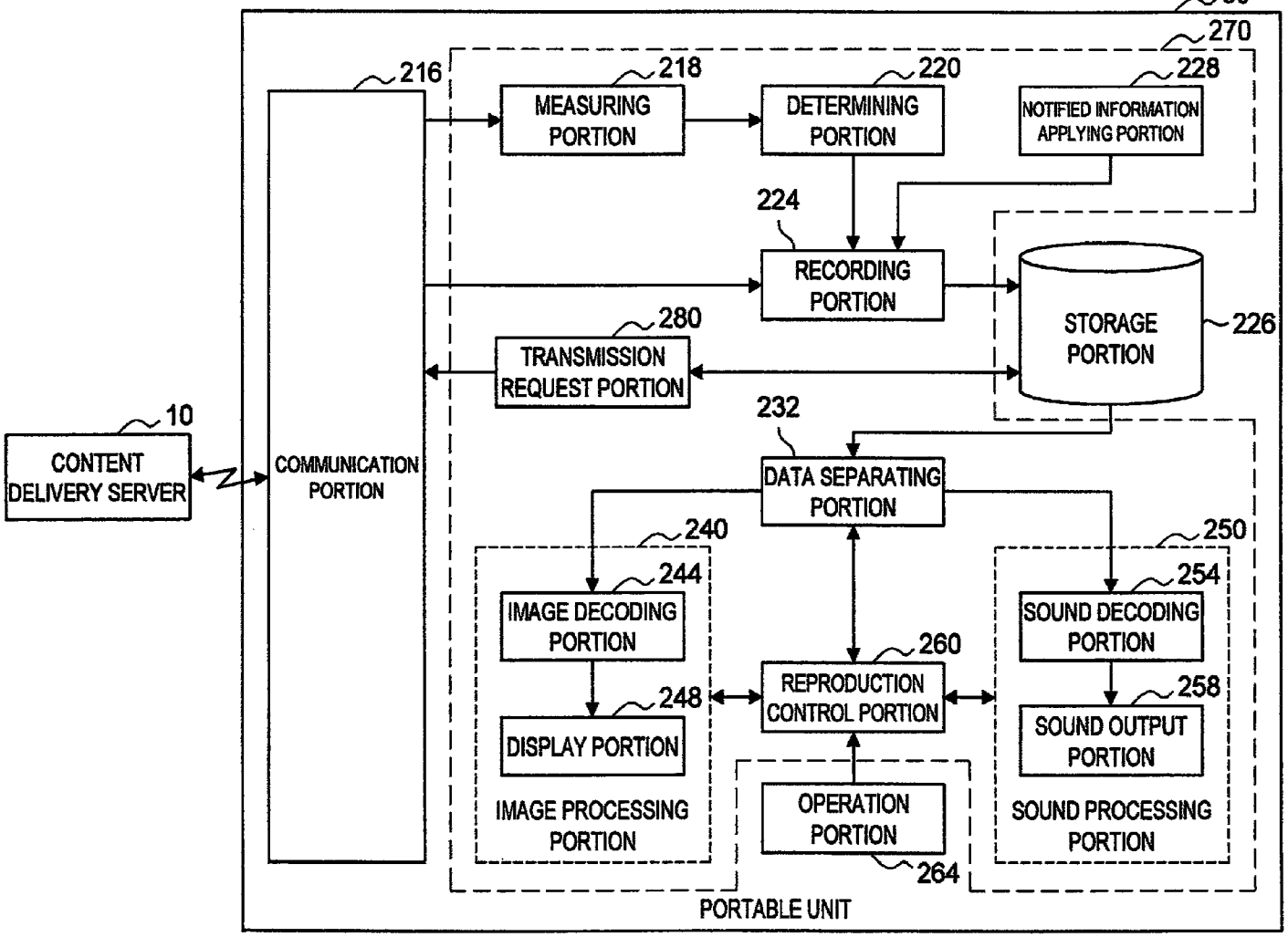
FIG. 14 is a functional block diagram showing the configuration of the portable apparatus according to a third embodiment of the present invention.

FIG. 14 is a functional block diagram showing the configuration of the portable apparatus 60 according to this embodiment. The portable apparatus 60 includes the communication portion 216, the measuring portion 218, the determining portion 220, the data type specifying portion 222, the recording portion 224, the storage portion 226, the notification information applying portion 228, the data separating portion 232, the video processing portion 240, the sound processing portion 250, the reproduction control portion 260 and a sending request portion 280.

The sending request portion 280 requests an external unit to resend a data range (portion of the content data) not recorded in the storage portion 226 based on determination of the determining portion 220 of the content data which the portable apparatus 60 attempts to acquire. For example, if the portable apparatus 60 does not record frame 3-frame 45 as shown in FIG. 6, the sending request portion 280 can request the external unit such as the content delivery server 10, the PC 30 to resend frame 3-frame 45. For example, the sending request portion 280 can request resending of the content data based on the meta data as notification information recorded in correspondence with the content data. Hereinafter, a specific means for requesting resending of the content data will be described with reference to FIG. 15.

Figure 15:
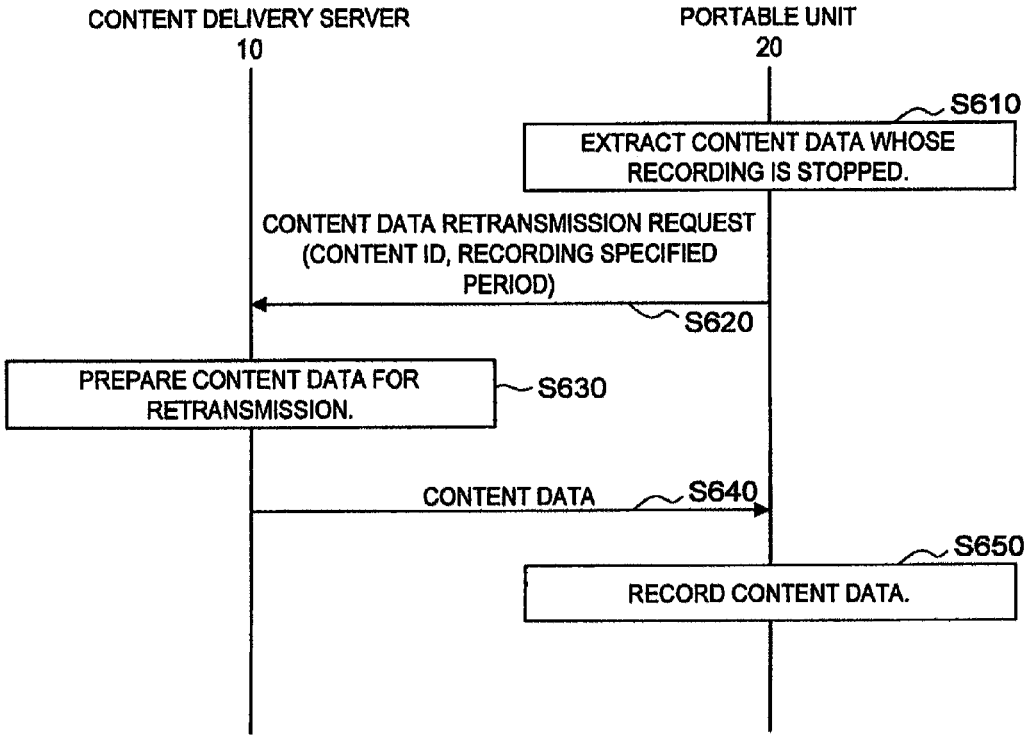
FIG. 15 is a sequence diagram showing a flow of replenishment of the content data by the portable apparatus according to the third embodiment.

FIG. 15 is a sequence diagram showing a flow of replenishment of the content data by the portable apparatus 60 according to this embodiment. First, the sending request portion 280 of the portable apparatus 60 extracts the content data whose recording is stopped even if partly, based on the meta data as the notification information recorded in correspondence to the content data (S610). Subsequently, the sending request portion 280 sends the content ID and information about content data recording stop period, contained in the meta data to the content delivery server 10 as a resending request of the content data extracted in S610.

When the meta data shown in FIG. 9 is matched to the content data, the sending request portion 280 sends content ID "14114411", and a recording stop period "T1-T2" to the content delivery server 10 as a resending request of the content data. In the meantime, the meta data may contain information indicating sender URI (Uniform Resource Identifier) of the content data and the sending request portion 280 may request resending of the content data based on the sender URI. Further, the sender unit does not necessarily coincide with the sending request unit.

After that, in the content delivery server 10, a portion of the content data corresponding to the recording stop period received from the portable apparatus 60 of the content data corresponding to the content ID received form the portable apparatus 60 is prepared (S630). For example, the content delivery server 10 prepares a portion of the content data whose data range is "T1-T2" of the content data whose content ID is "14114411".

Next, the content delivery server 10 sends the portion of the content data prepared in S630 to the portable apparatus 60 (S640). Then, the recording portion 224 of the portable apparatus 60 records a portion of the content data received from the content delivery server 10 in the storage portion 226.

As described above, the portable apparatus of the third embodiment of the present invention can replenish a portion not recorded in the storage portion 226 based on a determination of the determining portion 220 of a content data which the portable apparatus 60 attempts to acquire, effectively. That is, because the portable apparatus 60 according to this embodiment can request to resend only a portion of the content data not recorded in the storage portion 226 and receive based on determination of the determining portion 220, thereby making it possible to suppress communication cost, communication amount and communication time.

It should be understood by those skilled in the art that various modifications, combinations, sub-combinations and alterations may occur depending on design requirements and other factors insofar as they are within the scope of the appended claims or the equivalents thereof.

Although in the first embodiment, a case where the determining portion 220 determines whether or not the content data is to be recorded in the recording portion 224 based on the signal intensity measured by the measuring portion 218 has been described, the present invention is not restricted to such an example. As an example, the determining portion 220 may determine whether or not the content data is to be recorded in the recording portion 224 based on image or sound reproduced based on the content data received by the communication portion 216. If the content data is based on digital broadcasting, the content data received under a lower signal intensity than a certain level can sometimes be an image filled with black. Thus, if the image to be reproduced is an image filled with black, the determining portion 220 may determine not to record the content data in the recording portion 224.

Respective steps of processing of the portable apparatus 20 according to this specification do not need to be carried out in time series along a sequence described in the flow chart or a sequence diagram, and may contain processing (for example, parallel processing or processing with an object) to be executed in parallel or individually.

Further, a computer program for making hardware such as the CPU 201, ROM 202 and RAM 203 incorporated in the portable apparatus 20 exert the same function as the respective components of the above-described portable apparatus 20 can be produced. Additionally, a storage medium which stores the above-described computer program is provided.

What is claimed is:

1. A recording apparatus comprising:

a receiving portion for receiving a content data sent using radio wave;

a recording portion for recording the content data received by the receiving portion in a storage medium;

a determining portion for determining whether or not a receiving status of the content data by the receiving portion satisfies a predetermined standard; and a control portion for when the determining portion determines that the predetermined standard is not satisfied, controlling the recording portion to stop recording of the content data to the storage medium, wherein the predetermined standard is a predetermined value, and wherein the determining portion, when plural data types are contained in the content data each having a respective predetermined standard or value associated therewith, determines whether or not a condition of the content data as received satisfies the respective predetermined standard for each of the data types contained in the content data, and in which the control portion stops recording of the content data of a respective one or ones of the data types which are determined not to satisfy the respective predetermined standard or standards and does not stop recording of the content data of other respective one or ones of the data types which are determined to satisfy the respective predetermined standard or standards such that if a first data type and a second data type are contained in the content data, the control portion stops recording of the content data of the first data type when the determining portion determines that the content data of the first data type does not satisfy the respective predetermined standard and the control portion does not stop recording of the content data of the second data type when the determining portion determines that the content data of the second data type satisfies the respective predetermined standard.

2. The recording apparatus according to claim 1 wherein when recording of the content data to the storage medium is stopped, the control portion controls the recording portion to record notification information saying that recording of the content data is stopped into the storage medium.

3. The recording apparatus according to claim 2 wherein the notification information is image information or sound information indicating that recording of the content data is stopped, and the control portion controls the recording portion to insert the notification information into a data position in which storage of the content data into the storage medium is stopped.

4. The recording apparatus according to claim 2 wherein the notification information is additional information to be added to the content data containing information indicating the position in which memory of the content data is stopped.

5. The recording apparatus according to claim 4 further comprising a reproducing portion for reproducing the content data memorized in the storage medium, wherein the reproducing portion, when the notification information is matched to one of the content data to be reproduced, reproduces image information or sound information indicating that recording of the content data is stopped at a position in which the storage of the content data is stopped, based on the notification information.

6. The recording apparatus according to claim 4 wherein the notification information contains stop information indicating a range in which recording of the content data by the recording portion is stopped.

7. A recording apparatus comprising:

a receiving portion for receiving a content data sent using radio wave;

a recording portion for recording the content data received by the receiving portion in a storage medium;

a determining portion for determining whether or not a receiving status of the content data by the receiving portion satisfies a predetermined standard; and a control portion for when the determining portion determines that the predetermined standard is not satisfied, controlling the recording portion to stop recording of the content data to the storage medium, wherein the predetermined standard is a predetermined value, wherein when recording of the content data to the storage medium is stopped, the control portion controls the recording portion to record notification information saying that recording of the content data is stopped into the storage medium, wherein the notification information is additional information to be added to the content data containing information indicating the position in which memory of the content data is stopped, wherein the notification information contains stop information indicating a range in which recording of the content data by the recording portion is stopped, and wherein identification information of each of the content data is matched to the content data, the recording apparatus further comprising a sending request portion for requesting resending of the content data of a range in which the recording is stopped, based on the identification information matched to the content data and stop information contained in the notification information.

8. A recording method comprising the steps of:

receiving content data sent using radio wave;

determining whether or not the received condition of the content data satisfies a predetermined standard; and stopping recording of the content data to the storage medium when it is determined that the received condition does not satisfy the predetermined standard, wherein the predetermined standard is a predetermined value, and wherein the determining step, when plural data types are contained in the content data each having a respective predetermined standard or value associated therewith, determines whether or not a condition of the content data as received satisfies the respective predetermined standard for each of the data types contained in the content data, and in which the stopping step stops recording of the content data of a respective one or ones of the data types which are determined not to satisfy the respective predetermined standard or standards and does not stop recording of the content data of other respective one or ones of the data types which are determined to satisfy the respective predetermined standard or standards such that if a first data type and a second data type are contained in the content data, the stopping step stops recording of the content data of the first data type when the determining step determines that the content data of the first data type does not satisfy the respective predetermined standard and the stopping step does not stop recording of the content data of the second data type when the determining step determines that the content data of the second data type satisfies the respective predetermined standard.

9. A computer readable storage medium having recorded thereon a program for making a computer execute the steps of:

making a receiving portion received content data sent using radio wave;

determining whether or not the received condition of the content data satisfies a predetermined standard; and controlling the recording portion to stop recording of the content data into the storage medium when it is determined that the received condition does not satisfy the predetermined standard, wherein the predetermined standard is a predetermined value, and wherein the determining step, when plural data types are contained in the content data each having a respective predetermined standard or value associated therewith, determines whether or not a condition of the content data as received satisfies the respective predetermined standard for each of the data types contained in the content data, and in which the stopping step stops recording of the content data of a respective one or ones of the data types which are determined not to satisfy the respective predetermined standard or standards and does not stop recording of the content data of other respective one or ones of the data types which are determined to satisfy the respective predetermined standard or standards such that if a first data type and a second data type are contained in the content data, the stopping step stops recording of the content data of the first data type when the determining step determines that the content data of the first data type does not satisfy the respective predetermined standard and the stopping step does not stop recording of the content data of the second data type when the determining step determines that the content data of the second data type satisfies the respective predetermined standard.

10. A recording apparatus comprising:

a receiving means for receiving content data sent using radio wave;

a recording means for recording the content data received by the receiving means into a storage medium;

a determining means for determining whether or not received condition of the content data by the receiving means satisfies a predetermined standard; and a control means which when the determining means determines that the standard is not satisfied, controls the recording means to stop recording of the content data to the storage medium, wherein the predetermined standard is a predetermined value, and wherein the determining means, when plural data types are contained in the content data each having a respective predetermined standard or value associated therewith, determines whether or not a condition of the content data as received satisfies the respective predetermined standard for each of the data types contained in the content data, and in which the control means stops recording of the content data of a respective one or ones of the data types which are determined not to satisfy the respective predetermined standard or standards and does not stop recording of the content data of other respective one or ones of the data types which are determined to satisfy the respective predetermined standard or standards such that if a first data type and a second data type are contained in the content data, the control means stops recording of the content data of the first data type when the determining means determines that the content data of the first data type does not satisfy the respective predetermined standard and the control means does not stop recording of the content data of the second data type when the determining means determines that the content data of the second data type satisfies the respective predetermined standard.

* * * * *